US008866562B2

(12) United States Patent
Shimura et al.

(10) Patent No.: US 8,866,562 B2
(45) Date of Patent: Oct. 21, 2014

(54) SIGNAL CONVERTER INCLUDING A CONDUCTIVE PATCH FOR CONVERTING SIGNALS BETWEEN A HOLLOW WAVEGUIDE AND A DIELECTRIC WAVEGUIDE AND METHOD OF MANUFACTURE

(75) Inventors: Toshihiro Shimura, Kawasaki (JP); Yoji Ohashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 649 days.

(21) Appl. No.: 12/875,353

(22) Filed: Sep. 3, 2010

(65) Prior Publication Data

US 2011/0057743 A1 Mar. 10, 2011

(30) Foreign Application Priority Data

Sep. 5, 2009 (JP) ..... 2009-205388

(51) Int. Cl.
*H01P 5/08* (2006.01)
*H01P 5/02* (2006.01)
*H01P 11/00* (2006.01)

(52) U.S. Cl.
CPC ..... *H01P 5/024* (2013.01); *H01P 5/087* (2013.01); *H01P 11/002* (2013.01)
USPC ..... 333/21 R; 333/26; 333/33

(58) Field of Classification Search
CPC ..... H01P 5/087; H01P 5/082
USPC ..... 333/26, 33, 21 R
See application file for complete search history.

(56) References Cited

U.S. PATENT DOCUMENTS

| | | | | |
|---|---|---|---|---|
| 6,580,335 | B1 | 6/2003 | Iizuka et al. | |
| 7,148,765 | B2 | 12/2006 | Tahara et al. | |
| 7,586,386 | B2 | 9/2009 | Takahashi | |
| 2004/0119554 | A1 * | 6/2004 | Tahara et al. | 333/26 |
| 2005/0200424 | A1 * | 9/2005 | Takeda et al. | 333/26 |
| 2007/0052504 | A1 * | 3/2007 | Fujita | 333/238 |
| 2007/0085626 | A1 | 4/2007 | Lee et al. | |
| 2007/0182505 | A1 * | 8/2007 | Fujita et al. | 333/26 |
| 2008/0309427 | A1 * | 12/2008 | Kim et al. | 333/33 |

FOREIGN PATENT DOCUMENTS

| | | | |
|---|---|---|---|
| JP | 2000-244212 | A | 9/2000 |
| JP | 2003-273612 | A | 9/2003 |
| JP | 2003-289201 | A | 10/2003 |
| JP | 2006-295891 | A | 10/2006 |
| JP | 2007-12710 | A | 1/2007 |
| JP | 2008-131513 | A | 6/2008 |

OTHER PUBLICATIONS

Japanese Office Action mailed Sep. 10, 2013 for corresponding Japanese Application No. 2009-205388, with Partial English-language Translation.

* cited by examiner

*Primary Examiner* — Benny Lee
(74) *Attorney, Agent, or Firm* — Fujitsu Patent Center

(57) ABSTRACT

A signal converter configured to convert a signal between a substrate unit and a hollow waveguide includes a substrate unit, including a first conductor layer formed on one face of a dielectric substrate, and a second conductor layer formed on another face of the dielectric substrate, a plurality of conduction units that penetrate the dielectric substrate and provide conduction between the first conductor layer and the second conductor layer, an dielectric waveguide formed by the dielectric substrate, the first and second conductor layers, and the conduction units, and a conversion unit that converts the signal between the hollow waveguide and the dielectric waveguide, the conversion unit including a conductor patch having a separator region between itself and the first conductor layer, with the conductor patch being disposed on the substrate unit within an aperture of the hollow waveguide.

12 Claims, 34 Drawing Sheets

SIGNAL CONVERTER INCLUDING A CONDUCTIVE PATCH FOR CONVERTING SIGNALS BETWEEN A HOLLOW WAVEGUIDE AND A DIELECTRIC WAVEGUIDE AND METHOD OF MANUFACTURE

CROSS-REFERENCE TO RELATED APPLICATIONS

This application is based upon and claims the benefit of priority of the prior Japanese Patent Application No. 2009-205388, filed on Sep. 5, 2009, the entire contents of which are incorporated herein by reference.

FIELD

The embodiments described herein relate to a signal converter and a method of manufacturing the same.

BACKGROUND

Consider a high frequency signal, particularly one in a short wavelength frequency band, such as an extremely high frequency (EHF) wave. When such a signal is to be emitted from or received by an antenna using a transmitter circuit or a receiver circuit, the signal is converted from the transmitter circuit signal format, which is used between the transmitter circuit and the antenna as well as between the receiver circuit and the antenna, to a hollow waveguide signal propagation mode. Alternatively, the signal may be converted from the hollow waveguide signal propagation mode to the receiver circuit signal format. A signal converter is used for such signal conversion.

There exist several proposed structures for coupling a circuit chip or similar device that constitutes the transmitter circuit and receiver circuit with a waveguide. For example, the structure proposed in Japanese Laid-open Patent Publication No. 2003-289201 is provided with a first resonator that connects to a hollow waveguide, and a second resonator that couples with the first resonator. In such a structure, the end of a post-wall waveguide at the first resonator is closed by an array of through conductors, and a coupling window for connecting with the hollow waveguide is provided. The first and second resonators are formed by narrowing the H-plane of the post-wall waveguide at a predetermined interval.

As another example, in the structure proposed in Japanese Laid-open Patent Publication No. 2000-244212, a shorting metal layer is provided on one face of a dielectric substrate, while on the other face there is provided a grounding metal layer in the same shape as the aperture cross-section of a hollow waveguide. Electric potentials are kept equal by the grounding metal layer, the shorting metal layer, and metal embedding the waveguide in the dielectric substrate. In this case, a matching element is installed on the front face of the dielectric substrate enclosed by the grounding metal.

As another example, in the structure proposed in Japanese Laid-open Patent Publication No. 2008-131513, a first ground layer is provided on one face of a dielectric substrate, while a second ground layer is provided on the other face. A hollow waveguide is provided on the side of the first ground layer, and a patch is provided in a notch of the first ground layer.

As another example, in the structure proposed in Japanese Laid-open Patent Publication No. 2006-295891, first and second dielectric substrates are provided, with an hollow coupling conductor for a coplanar strip transmission line installed on the first dielectric substrate, and with a ground conductor installed on the second dielectric substrate.

SUMMARY

According to an aspect of the present invention, a signal converter configured to convert a signal between a substrate unit and a hollow waveguide includes a substrate unit, including a first conductor layer formed on one face of a dielectric substrate, and a second conductor layer formed on another face of the dielectric substrate, a plurality of conduction units that penetrate the dielectric substrate and provide conduction between the first conductor layer and the second conductor layer, an waveguide formed by the dielectric substrate, the first and second conductor layers, and the conduction units, and a conversion unit that converts the signal between the waveguide and the hollow waveguide, the conversion unit including a conductor patch having a separator region between itself and the first conductor layer, with the conductor patch being disposed on the substrate unit within an aperture of the hollow waveguide.

The object and advantages of the present invention will be realized and attained by at least the elements, features, and combinations particularly pointed out in the claims.

It is to be understood that both the foregoing general description and the following detailed description are exemplary and explanatory and are not restrictive of the present invention, as claimed.

DESCRIPTION OF EMBODIMENTS

Figure 1:
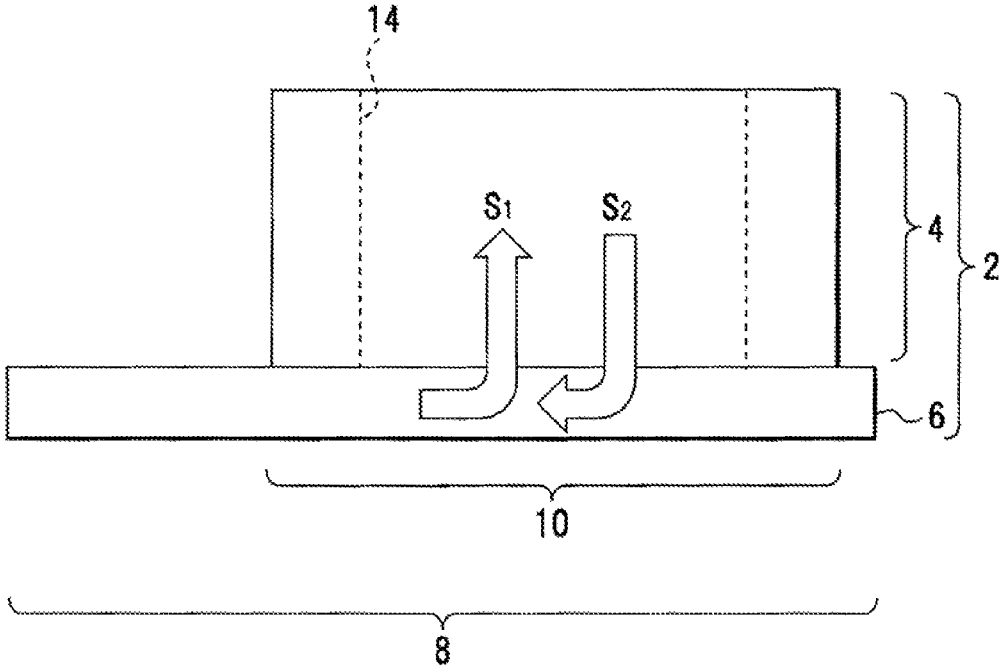
FIG. 1 illustrates an exemplary signal converter in accordance with a first embodiment.

In the figures, like reference labels refer to like features unless otherwise noted, and dimensions and/or proportions may be exaggerated for clarity of illustration. It will also be understood that when an element is referred to as being "connected to" another element, it may be directly connected or indirectly connected, i.e., intervening elements may also be present. Further, it will be understood that when an element is referred to as being "between" two elements, it may be the only element layer between the two elements, or one or more intervening elements may also be present.

In a structure provided with a plurality of conduction units that constitute a short wall and a coupling window that couples with the hollow waveguide (such as in JP-A-2003-289201 described above), the conduction units are provided with through-holes formed by a laser, drill, or other mechanism. Conductive material is loaded into and formed within such through-holes. The part of the conductor layer that corresponds to the coupling window is formed by cutting out a portion of the conductor layer by etching, for example.

However, due to fabrication inconsistencies, it is difficult to keep the distance that should be kept between the conduction unit array and the coupling window at the desired value. This affects the signal conversion characteristics. In other words, if variation is induced in the distance between the coupling window and the through conductor array, large fluctuations are produced in reflection characteristics for high-frequency signal frequencies. Depending on the frequencies used, waveguide propagation characteristics may also change significantly. In order to improve such characteristics, it is desirable to reduce the frequency dependence of the reflection characteristics.

In addition, depending on the coupling relationship between the hollow waveguide and the part of the substrate constituting the waveguide, higher-order modes or resonances may be produced. Such higher-order modes affect the fundamental resonance mode, and become a factor causing decreases in the signal conversion efficiency in the fundamental resonance mode.

Consequently, one object of the signal converter and manufacturing method disclosed herein is to suppress the effects of fabrication inconsistencies, and improve signal conversion characteristics.

In addition, another object of the signal converter and manufacturing method disclosed herein is to suppress higher-order modes and resonances, and raise the signal conversion efficiency.

In order to achieve the above objects, the signal converter or its manufacturing method disclosed herein involves a signal converter configured to convert a signal between a substrate unit and a hollow waveguide. In the signal converter, a conversion unit is provided on the substrate unit where upon an waveguide is formed. A separator region is provided between the conversion unit and a conductor layer on the substrate unit. A conductor patch is also provided, and disposed on the substrate unit within an aperture of the hollow waveguide. By providing such a configuration, the above objects are achieved.

Thus, in order to achieve the above objects, the signal converter disclosed herein is a signal converter configured to convert a signal between a substrate unit and a hollow waveguide, and is provided with: a substrate unit, a plurality of conduction units, an waveguide, and a conversion unit. In the substrate unit, a first conductor layer is formed on one face of a dielectric substrate, and a second conductor layer is formed on another face of the dielectric substrate. The plurality of conduction units penetrate the dielectric substrate and provide conduction between the first conductor layer and the second conductor layer. The waveguide is formed by the dielectric substrate, the first and second conductor layers, and the conduction units. The conversion unit converts the signal between the hollow waveguide and the waveguide, and is provided with a conductor patch having a separator region between itself and the first conductor layer, with the conductor patch being disposed on the substrate unit within the aperture of the hollow waveguide.

In addition, in order to achieve the above objects, the method of manufacturing a signal converter disclosed herein includes the steps of forming a substrate unit, and joining the substrate unit with a hollow waveguide. In the substrate unit forming step, a substrate unit is formed wherein a first conductor layer is provided on one face of a dielectric substrate, a second conductor layer is provided on another face of the dielectric substrate, and a plurality of conduction units are provided that penetrate the dielectric substrate and provide conduction between the first conductor layer and the second conductor layer. On this substrate unit, there is provided an waveguide formed by the dielectric material portion of the dielectric substrate, and substantially surrounded by the first and second conductor layers as well as the conduction units.

A conductor patch is also provided at a conversion unit formed in the waveguide, and a separator region is formed between the conductor patch and the first conductor layer. Subsequently, in the joining step, the substrate unit is joined with a hollow waveguide.

According to the signal converter disclosed herein, advantages like the following are obtained.

(1) Since signal conversion is conducted with a conductor patch installed at the junction between the substrate and the hollow waveguide, the frequency dependence of the signal conversion characteristics is reduced, the effects of fabrication layout errors is alleviated, and signal conversion characteristics can be improved.

(2) Signal conversion characteristics due to fabrication errors at sites that lead signals to the hollow waveguide can be improved.

(3) The production of higher-order modes or resonances can be suppressed, the effects of higher-order modes on the fundamental resonance mode can be reduced, and the signal conversion efficiency in the fundamental resonance mode can be raised.

In addition, according to the method of manufacturing a signal converter disclosed herein, advantages like the following are obtained.

(1) A signal converter with improved signal conversion characteristics can be manufactured.

(2) Degradation in the signal conversion characteristics of a signal converter due to fabrication errors can be reduced.

Other objects, features, and advantages of the present invention will become more apparent upon consulting the respective embodiments and attached drawings.

First Embodiment

The first embodiment is provided with a conductor patch pattern in a signal conversion unit between the substrate and the hollow waveguide. The conductor patch pattern is separated from the conductor layer, and provided in the aperture region of the conductor layer. The signal conversion unit is actually referred to as a line-hollow waveguide converter.

The first embodiment will be described with reference to FIG. 1. FIG. 1 illustrates a signal converter in accordance with the first embodiment. It should be appreciated that the configuration illustrated in FIG. 1 is merely one example, and that the present invention is not limited to such a configuration.

As illustrated in FIG. 1, the signal converter 2 is provided with a hollow waveguide 4 and an waveguide substrate 6. The hollow waveguide 4 includes a hollow portion 14 which is a transmission path that transmits high-frequency signals (i.e., waveguide modes), and may be configured as a hollow waveguide, for example. The waveguide substrate 6 is one example of a substrate, and constitutes an waveguide 8. The waveguide 8 is a transmission path for transmitting in waveguide mode within the waveguide substrate 6.

The waveguide 8 is provided with a conversion unit 10 between itself and the hollow waveguide 4. The conversion unit 10 is a signal converting mechanism that converts signals from the waveguide 8 of the waveguide substrate 6 to the hollow waveguide 4 (as indicated by the arrow $S_1$), or alternatively, from the hollow waveguide 4 to the waveguide 8 of the waveguide substrate 6 (as indicated by the arrow $S_2$).

The signal converter 2 will now be described with reference to FIGS. 2-9. It should be appreciated that the configuration illustrated in FIGS. 2-9 is merely one example, and that the present invention is not limited to such a configuration. In FIGS. 2-9, identical reference numbers are used for portions identical to those in FIG. 1.

Figure 2:
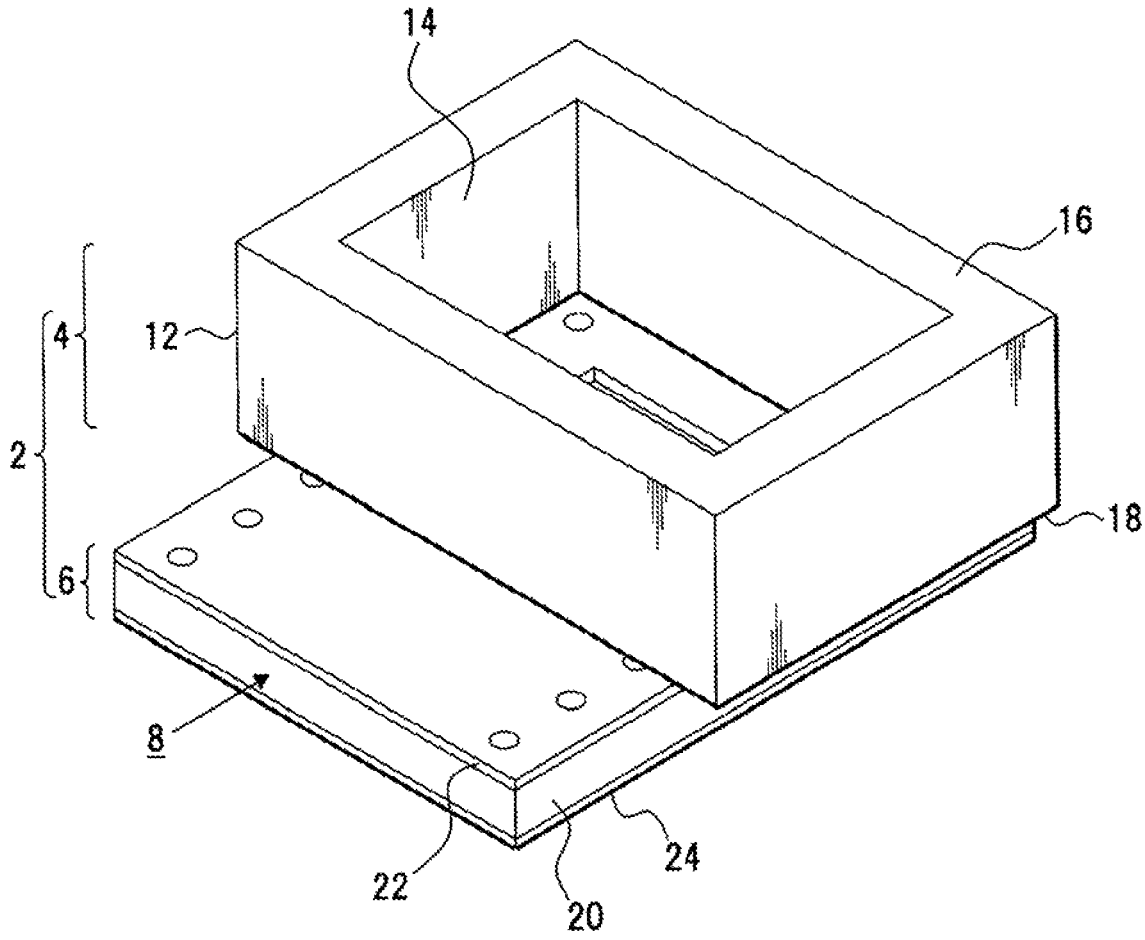
FIG. 2 is a perspective view illustrating an exemplary signal converter.
Figure 3:
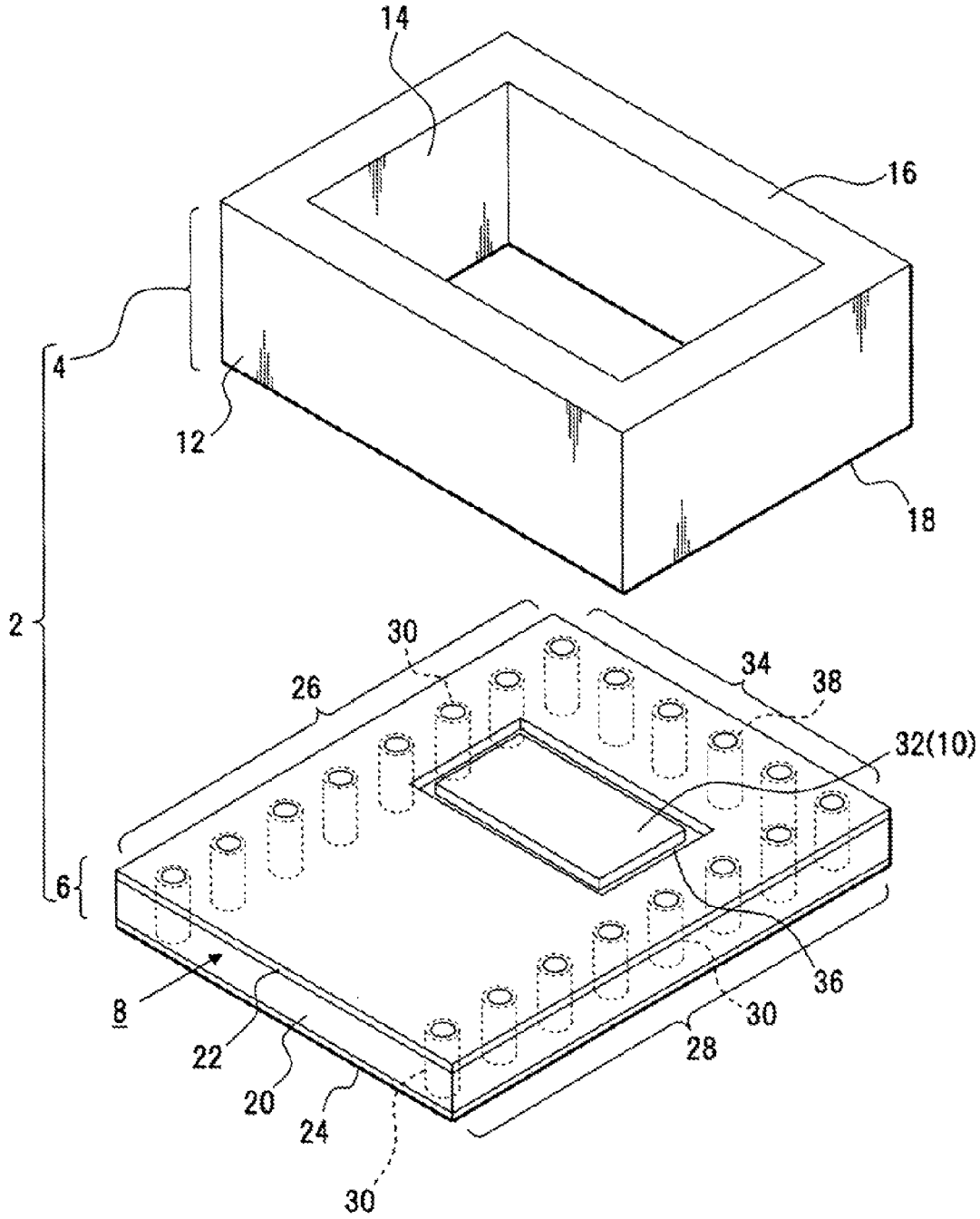
FIG. 3 is an exploded perspective view illustrating an exemplary hollow waveguide and waveguide substrate of a signal converter.
Figure 4:
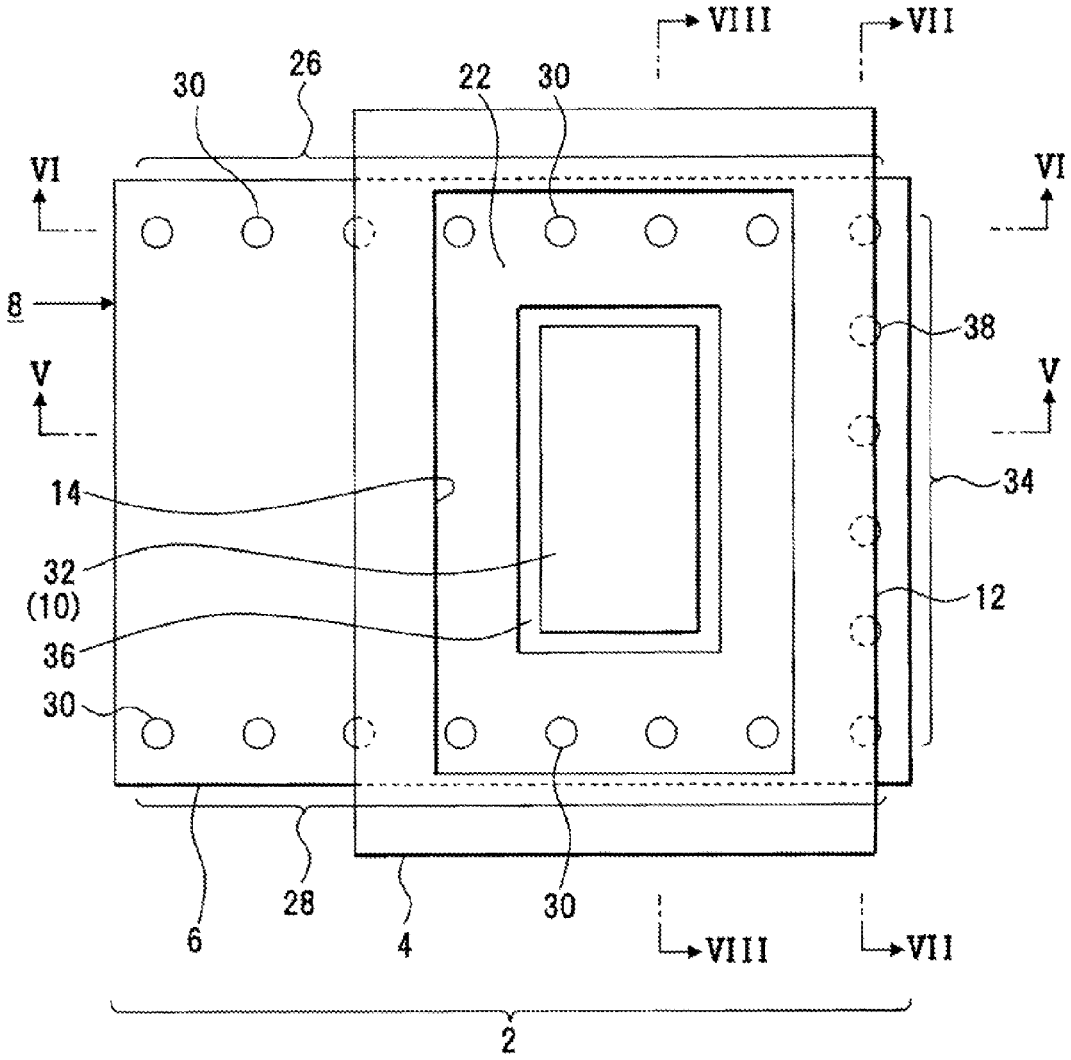
FIG. 4 illustrates an exemplary signal converter as viewed from a hollow waveguide.
Figure 5:
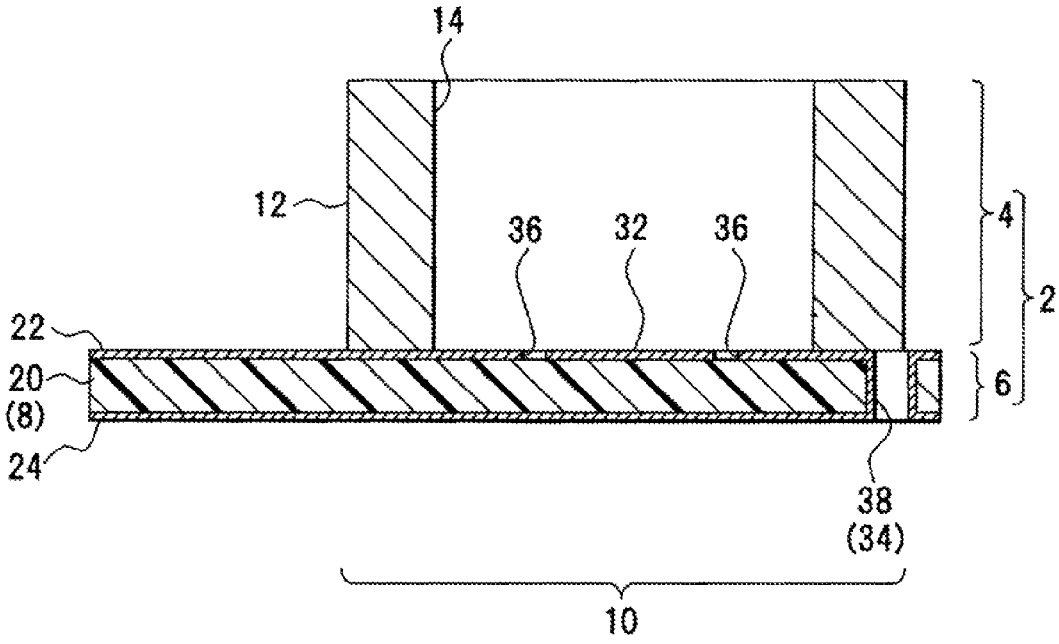
FIG. 5 is a cross section taken along the line V-V in FIG. 4.
Figure 6:
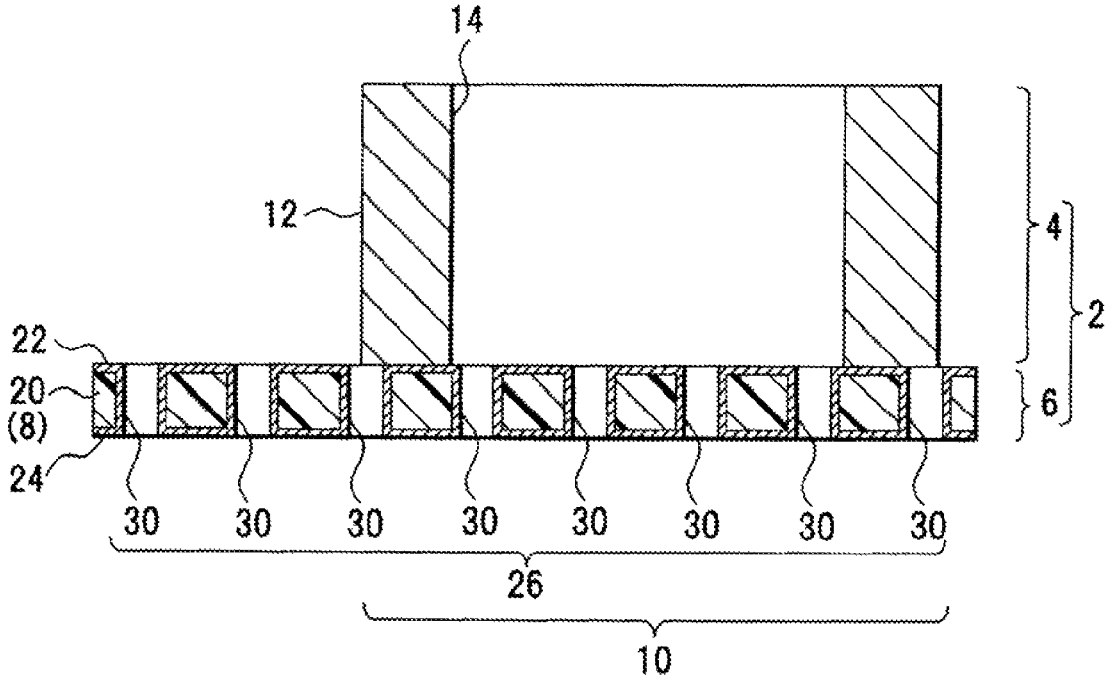
FIG. 6 is a cross section taken along the line VI-VI in FIG. 4.
Figure 7:
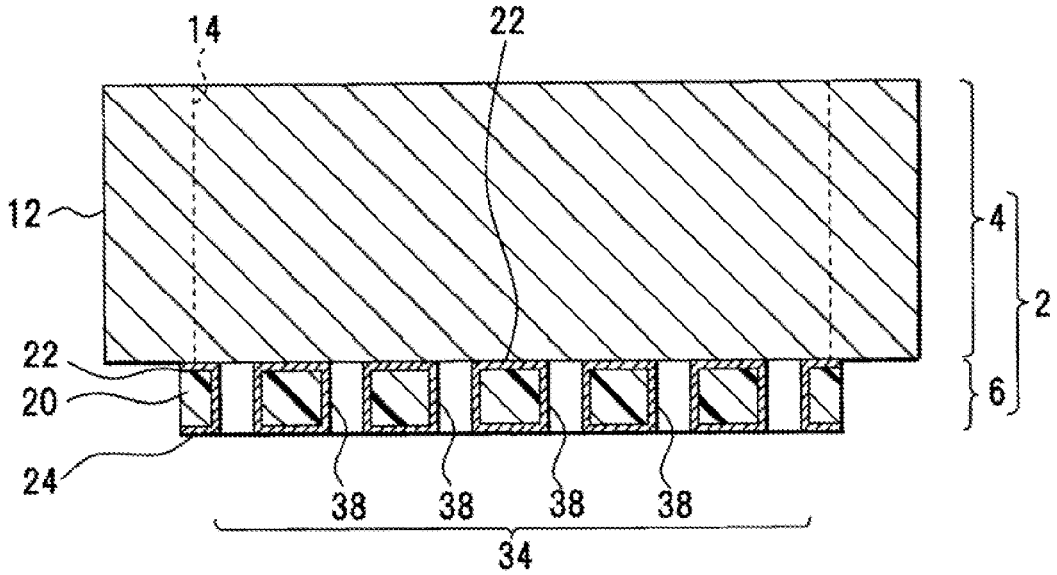
FIG. 7 is a cross section taken along the line VII-VII in FIG. 4.
Figure 8:
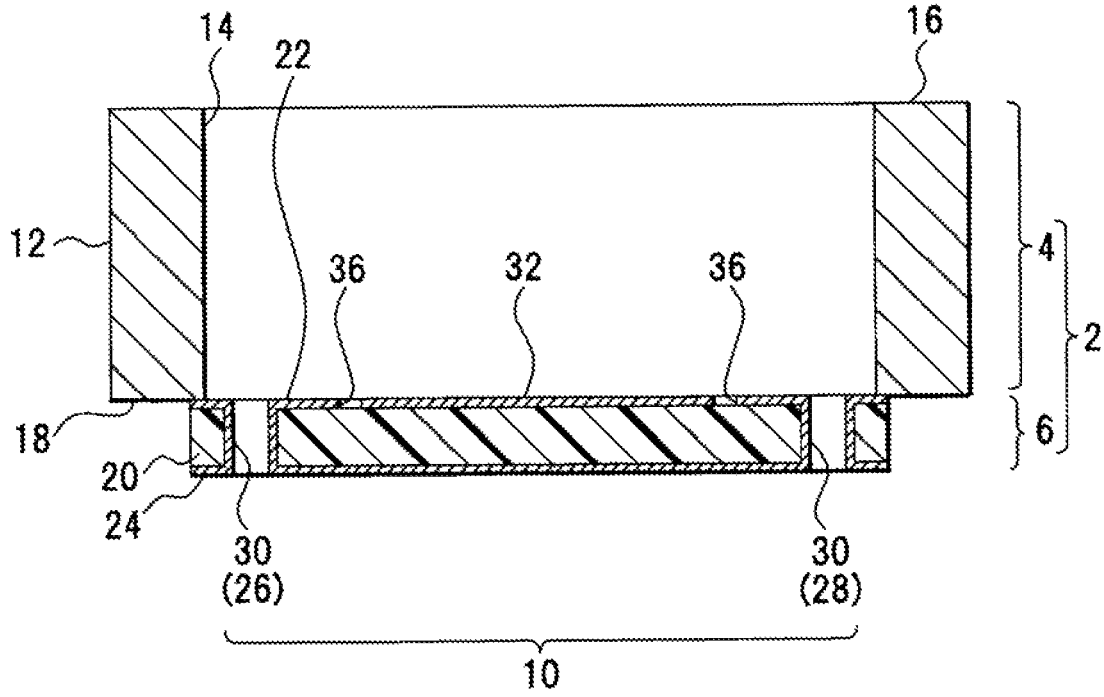
FIG. 8 is a cross section taken along the line VIII-VIII in FIG. 4.
Figure 9:
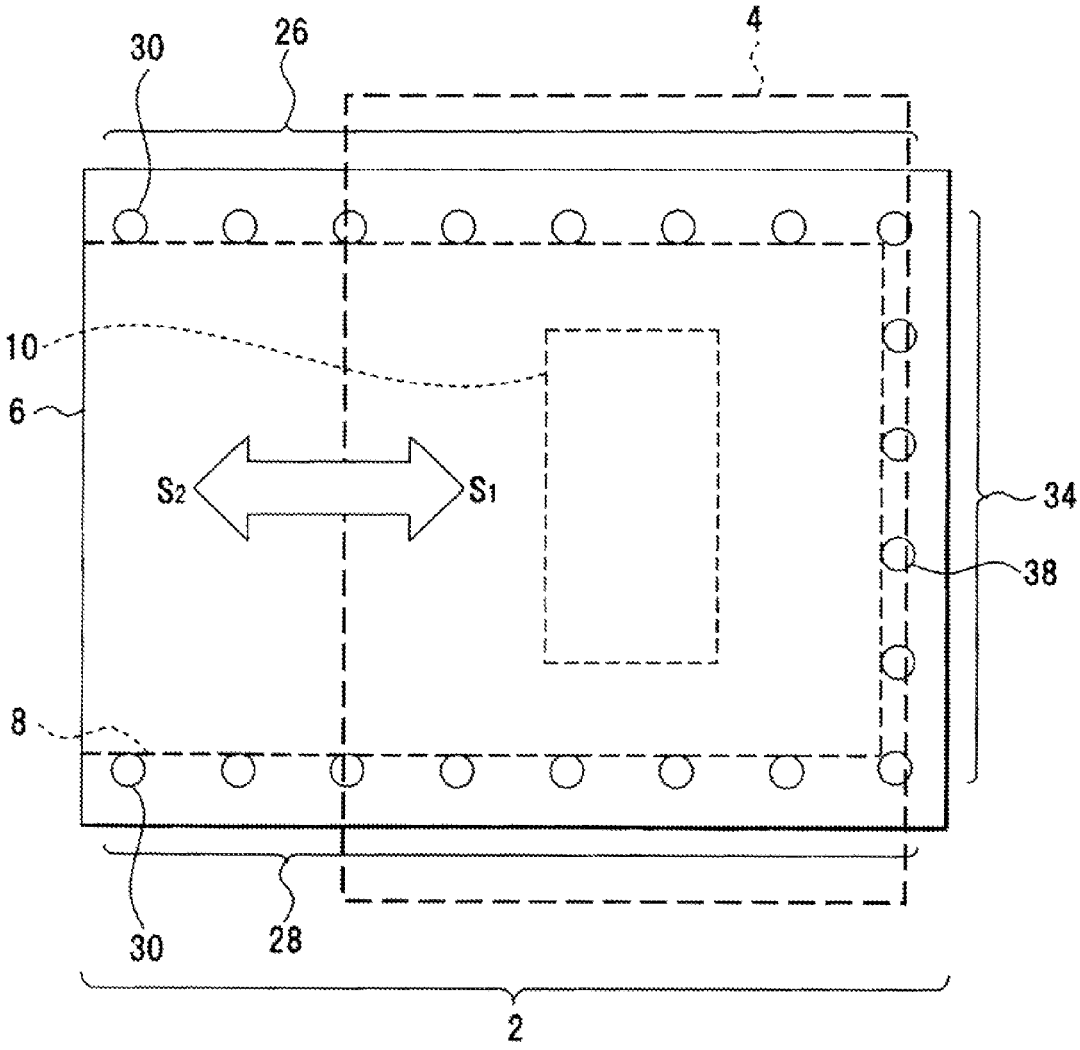
FIG. 9 illustrates an exemplary waveguide and a conversion unit.

As illustrated in FIGS. 2 and 3, the hollow waveguide 4 is a hollow waveguide provided with a polygonal pipe body unit 12 formed from a conductor, as well as a polygonal pipe hollow portion 14. On the top and bottom surfaces, there are provided aperture surfaces 16 and 18. It should be appreciated that the shape of the hollow waveguide 4 is not limited to being a polygonal pipe, and that other shapes are also possible.

The waveguide substrate 6 is one example of a substrate that constitutes the waveguide 8 described earlier. A dielectric substrate 20 is used for the waveguide substrate 6. A first conductor layer 22 is formed on a first face of the dielectric substrate 20 (such as the front, for example) together to form a dielectric waveguide, while a second conductor layer 24 is formed on its second face (such as the back, for example). The dielectric substrate 20 is one example of a dielectric plate. A dielectric resin, for example, may be used as the dielectric material. However, the dielectric material is not limited to resins, and may also be a material such as ceramic.

Along the lengthwise edges of the waveguide substrate 6, there are disposed first and second conduction through-hole arrays 26 and 28 (as shown, e.g., in FIG. 3). Each of the conduction through-hole arrays 26 and 28 is one example of a plural array of conduction units that join the conductor layers 22 and 24. In other words, the conduction through-hole arrays 26 and 28 are connecting mechanisms that connect the conductor layers 22 and 24. Consequently, in the waveguide substrate 6, the tubular waveguide 8 is enclosed by the conductor layers 22 and 24 as well as the conduction through-hole arrays 26 and 28. The waveguide 8 is formed in the direction intersecting (i.e., the direction orthogonal to) the hollow portion 14 of the hollow waveguide 4. The waveguide 8 is a transmission path that transmits in waveguide mode within the dielectric substrate 20, and constitutes an waveguide or waveguide within the substrate. Each of the conduction through-hole arrays 26 and 28 is made up of a plurality of conduction through-hole units 30 (as shown, e.g., in FIG. 3) arranged at a predetermined spacing.

The hollow waveguide 4 is disposed on the top face of the first conductor layer 22 on the waveguide substrate 6. The aperture surface 18 of the hollow waveguide 4 contacts the first conductor layer 22, with the hollow waveguide 4 and the waveguide substrate 6 being joined together. Thus, the conversion unit 10 described earlier is provided on the waveguide substrate 6 at the junction with the hollow waveguide 4.

The conversion unit 10 is provided with a conductor patch 32, and a blocking conduction through-hole array 34 (as shown, e.g., in FIG. 3). The conductor patch 32 is a mechanism for emitting a high-frequency signal transmitted along the waveguide 8 into the hollow portion 14 of the hollow waveguide 4, or alternatively, for emitting a high-frequency signal transmitted along the hollow portion 14 of the hollow waveguide 4 into the waveguide 8. In other words, the conductor patch 32 is a joining mechanism that joins the hollow waveguide 4 with the waveguide 8. The conductor patch 32 may be, for example, a rectangular conductor pattern formed with a conductor pattern similar to that of the conductor layer 22. A separator region 36 (as shown, e.g., in FIG. 3) is formed between the conductor patch 32 and the conductor layer 22. The separator region 36 is a separating mechanism that separates the conductor patch 32 from the conductor layer 22. The separator region 36 may be formed by cutting out a portion where no conductors exist, for example. The separator region 36 thus constitutes a junction gap, and is a mechanism for electromagnetically joining the conductor layer 22 with the conductor patch 32.

The blocking conduction through-hole array 34 (as shown, e.g., in FIG. 3) is a mechanism for blocking signals in the waveguide 8 of the waveguide substrate 6. The blocking conduction through-hole array 34 forms the end terminal of the waveguide 8, and blocks signals in waveguide mode transmitted within the waveguide 8. Similarly to the conduction through-hole arrays 26 and 28, the blocking conduction through-hole array 34 is made up of a plurality of blocking conduction through-hole units 38 (as shown, e.g., in FIG. 3) arranged at a predetermined spacing.

Consequently, as illustrated in FIGS. 4-9, an waveguide 8 is formed within the dielectric substrate 20 of the waveguide substrate 6, and a conversion unit 10 is formed on the blocking side of the waveguide 8 (in other words, the conversion unit 10 is formed at the junction with the hollow waveguide 4). With such a conversion unit 10, signals transmitted along the waveguide 8 of the waveguide substrate 6 are blocked by the blocking conduction through-hole array 34, and electromagnetically joined to the conductor patch 32 via a junction gap formed by the separator region 36. From the conductor patch 32, signals are emitted into the hollow portion 14 of the hollow waveguide 4. In addition, signals transmitted along the hollow portion 14 of the hollow waveguide 4 are inducted by the conductor patch 32, electromagnetically joined to the waveguide 8 from the conductor patch 32 via the junction gap formed by the separator region 36, and transmitted.

Figure 10:
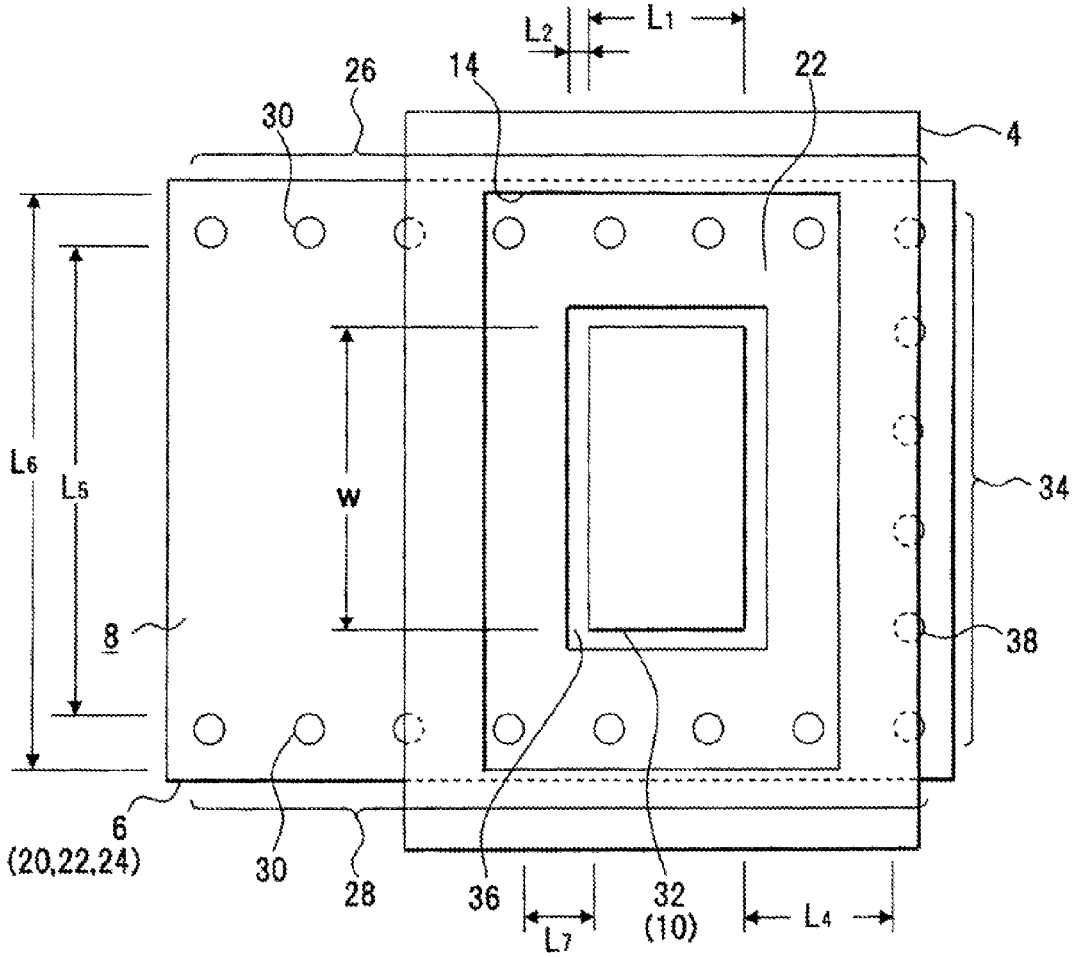
FIG. 10 illustrates, in detail, an exemplary hollow waveguide, an waveguide, conduction through-hole units, and a conversion unit.

The length and width of the conductor patch 32, the spacing of the separator region 36, and the distance between the conductor patch 32 and the blocking conduction through-hole array 34 will now be described with reference to FIG. 10. FIG. 10 illustrates an exemplary signal converter.

As illustrated in FIG. 10, the length of the conductor patch 32 is taken to be $L_1$. This length $L_1$ is the length in the direction of travel along the waveguide 8. If this length $L_1$ is set to a value equal to, or in the vicinity of, one-half the wavelength $\lambda$ (i.e., $\lambda/2$) of a high-frequency signal transmitted to the conductor patch 32, then the conductor patch 32 becomes a resonator. If the conductor patch 32 is configured to be a resonator, then signal conversion at a desired frequency f can be achieved. In other words, a signal in waveguide mode within the substrate can be electromagnetically joined to the conductor patch 32 (i.e., the resonator) via the junction gap (i.e., the separator region 36). From the conductor patch 32, a signal wave is emitted into the hollow waveguide 4, and signal conversion to the transmission mode of the hollow waveguide 4 is conducted. In this case, the width w of the conductor patch 32 (i.e., the width in the direction orthogonal to the length $L_1$) is set to a value equal to, or in the vicinity of, $2L_1$.

The junction length of the junction gap formed by the separator region 36 is taken to be $L_2$. This length $L_2$ is the length in the direction of travel along the waveguide 8. This junction length $L_2$ is set so as to be smaller than the thickness $L_3$ of the dielectric substrate 20 (see FIG. 11). In the case where the junction length $L_2$ is greater than the thickness $L_3$ of the dielectric substrate 20 (i.e., if $L_2>L_3$), waveguide signals within the substrate leak into a different mode by the long junction gap before reaching the conductor patch 32 that acts as the resonator. Furthermore, in this case, signal reflection is produced at the near edge of the junction gap, and it becomes difficult for resonance to occur at the desired frequency f. Such phenomena serve to lower the signal conversion efficiency. However, if the junction length $L_2$ is set smaller than the thickness $L_3$ of the dielectric substrate 20, then such phenomena can be suppressed, and lowered signal conversion efficiency can be suppressed.

In this case, a distance $L_4$ is set from the edge of the conductor patch 32 and extending in the direction of signal travel. The blocking conduction through-hole array 34 is disposed such that a spacing equal to the distance $L_4$ exists between the conductor patch 32 and the blocking conduction through-hole array 34. This distance $L_4$ may be set to a value equal to, or essentially in the vicinity of, an odd multiple of one-fourth the wavelength $\lambda$ (i.e., $\lambda/4$) of a signal propagated by the waveguide substrate 6.

The width of the waveguide 8 is taken to be $L_5$. In order to prevent or at least reduce the production of higher-order modes, the width $L_5$ may be set according to the following Eq. 1.

$$L_5<\lambda_0/\sqrt{(\in_\gamma)} \tag{1}$$

More preferably, the width $L_5$ may be set according to the following Eq. 2.

$$L_5 < \frac{\lambda_0 / \sqrt{(\varepsilon_\gamma)}}{2} \tag{2}$$

Herein, $\in_r$ is the relative permittivity of the dielectric substrate 20, and $\lambda_0$ is equal to c/f, where c is the speed of light, and f is the frequency. Herein, the guide wavelength $\lambda_g$ is expressed in Eq. 3.

$$\lambda_g = \frac{\lambda_0}{\sqrt{\varepsilon_\gamma}} \cdot \frac{1}{\sqrt{1 - \frac{1}{\varepsilon_\gamma} \cdot \left(\frac{\lambda_0}{2a}\right)^2}} \tag{3}$$

If the width $L_5$ of the waveguide 8 is increased, then the guide wavelength $\lambda_g$ becomes shorter. In contrast, if the width $L_5$ is decreased, then the guide wavelength $\lambda_g$ becomes longer. In Eq. 3, a is the width of the waveguide 8, and is equal to $L_5$.

In addition, the frequency of the signals converted in the hollow waveguide 4 need to be of a particular frequency band for the system. Consequently, when creating the converter, for example, the converter may be designed to take more than the needed relative bandwidth. One technique for widening the frequency band involves increasing the thickness $L_3$ of the dielectric substrate 20 (see FIG. 11), and lowering the sharpness Q of the resonance of the conductor patch 32.

At this point, consider the thickness $L_3$ of a given dielectric substrate 20. Air exists within the hollow portion 14 of the hollow waveguide 4. The relative permittivity $\in_r$ of this air is equal to 1, while the relative permittivity $\in_r$ of the dielectric substrate 20 is greater than 1. Ordinarily, the relative permittivity $\in_r$ of the resin used as the dielectric material for the dielectric substrate 20 is approximately 3 to 4. Thus, the width $L_5$ of the waveguide 8 should be set narrower than the aperture width $L_6$ (i.e., the long-edge width) of the hollow hollow waveguide 4 ($L_6>L_5$).

The spacing $L_7$ between adjacent conduction through-hole units 30 in the conduction through-hole arrays 26 and 28 should be narrow enough so that signals from the waveguide 8 do not leak out. Preferably, the spacing $L_7$ should be significantly smaller than one-fourth the wavelength $\lambda$ (i.e., $\lambda/4$), with a value not more than one-eighth the wavelength $\lambda$ (i.e., $\lambda/8$) being desirable.

Figure 11:
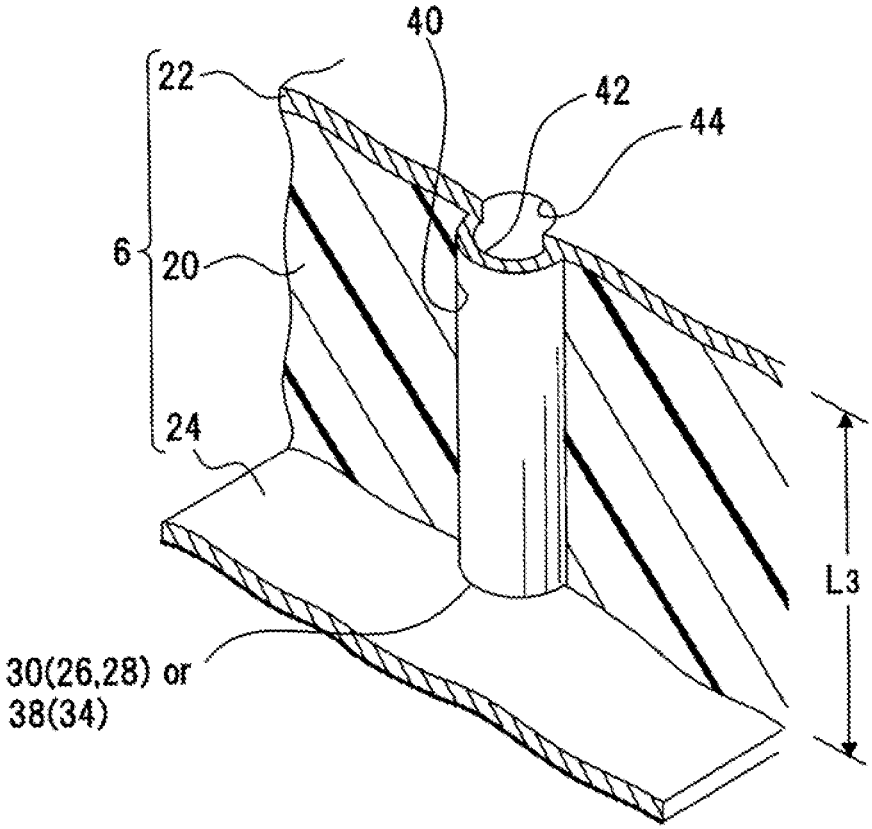
FIG. 11 illustrates an exemplary conduction through-hole unit (or a blocking conduction through-hole unit) in an waveguide substrate.

The through-hole units 30 will now be described with reference to FIG. 11. FIG. 11 illustrates an waveguide substrate from which a conduction through-hole unit (or a blocking-conduction through-hole unit) portion has been cut out. In FIG. 11, identical reference numbers are used for portions identical to those in FIG. 2 and FIG. 3.

As illustrated in FIG. 11, the conduction through-hole arrays 26 and 28 may be made up of conduction through-hole units 30 that penetrate the dielectric substrate 20 and connect the conductor layers 22 and 24 together. In this case, the conduction through-hole units 30 may be formed by punching or drilling through-holes 40 in the dielectric substrate 20, and then forming a conductor layer 42 on the inner walls of the through-holes 40. Consequently, in each conduction through-hole unit 30, a through-hole 44 is formed in the space enclosed by the conductor layer 42.

The blocking conduction through-hole array 34 may be similarly made up of blocking conduction through-hole units 38 that penetrate the dielectric substrate 20 and connect the conductor layers 22 and 24 together. In this case, the blocking conduction through-hole units 38 may also be formed by punching or drilling through-holes 40 in the dielectric substrate 20, and then forming a conductor layer 42 on the inner walls of the through-holes 40. Consequently, in each blocking conduction through-hole unit 38, a through-hole 44 is similarly formed in the space enclosed by the conductor layer 42.

Figure 12:
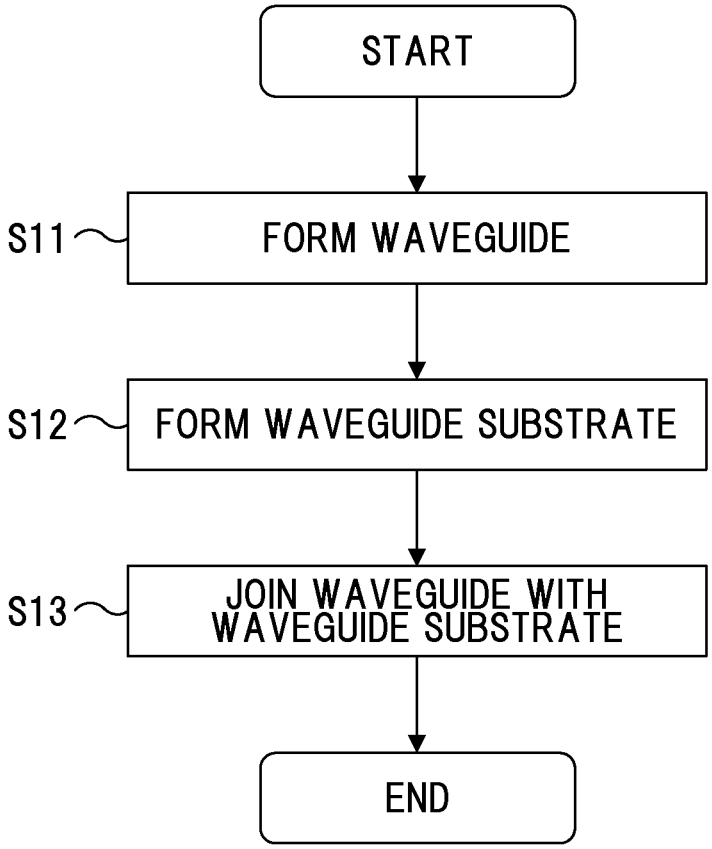
FIG. 12 is a flowchart illustrating one example of a method of manufacturing a signal converter.

A method of manufacturing such a signal converter will now be described with reference to FIG. 12. FIG. 12 is a flowchart illustrating one example of a method of manufacturing a signal converter.

This manufacturing process is one example of the manufacturing method disclosed herein, and as illustrated in FIG. 12, includes the steps of: starting with forming the hollow waveguide 4 (step S11); starting with forming the waveguide substrate 6 (step S12); and ending with joining the hollow waveguide 4 with the waveguide substrate 6 (step S13).

In the hollow waveguide 4 forming step (step S11), the hollow waveguide 4 described earlier may be formed. As illustrated in FIG. 2, the hollow waveguide 4 is formed having a polygonal pipe body.

In the waveguide substrate 6 forming step (step S12), the waveguide substrate 6 described earlier may be formed. In the waveguide substrate 6, the conductor layer 22 may be formed on the front surface of the dielectric substrate 20, while the conductor layer 24 may be formed on its back surface. The respective conductor layers 22 and 24 may be formed by a coating method wherein a conductor layer made up of a metal conductor is applied by techniques such as plating or vapor deposition. Alternatively, the respective conductor layers 22 and 24 may be formed by foil pressing (using copper foil, for example). The through-hole units 30 and 38 may be formed by punching the dielectric substrate 20, the conductor layer 22, and the conductor layer 24. The conductor layer 42 may then be disposed inside each of the respective through-hole units 30 and 38. In so doing, the conduction through-hole arrays 26 and 28, as well as the blocking conduction through-hole array 34, are formed. In the waveguide substrate 6 and the conductor layer 22 where the hollow waveguide 4 is disposed, the separator region 36 and the conductor patch 32 may be formed to constitute the conversion unit 10.

In the hollow waveguide 4 and waveguide substrate 6 joining step (step S13), the hollow waveguide 4 is disposed such that the conductor patch 32 on top of the waveguide substrate 6 described earlier fits into the aperture of the hollow waveguide 4 (or in other words, inside the hollow portion 14). In so doing, the signal converter 2 described earlier is obtained.

Modifications and features of the signal converter 2 in accordance with the first embodiment described above are given below.

(1) In the signal converter 2, there is provided a dielectric substrate 20, in addition to conductor layers 22 and 24 as well as conduction through-hole arrays 26 and 28 formed on either side of the dielectric substrate 20. The portion of the dielectric substrate enclosed by the two conduction through-hole arrays 26 and 28 (i.e., conduction post arrays) as well as the conductor layers 22 and 24 is configured to function as the waveguide 8.

(2) A conversion unit 10 that converts signals is provided in the waveguide 8, with the conversion unit 10 being provided at a position that blocks one end of the waveguide 8. In this conversion unit 10, a conductor patch 32 is provided in an aperture region where the conductor layer 22 is not formed (i.e., in the same planar surface enclosed by the separator region 36). By use of the separator region 36, the conductor patch 32 and the conductor layer 22 are insulated from each other, while also being electromagnetically joined via the separator region 36.

(3) The separator region 36 constitutes a gap such that the conductor patch 32 and the conductor layer 22 do not electrically contact each other. Via this gap, signals in waveguide transmission mode are joined to the conductor patch 32, which acts as a resonator. The resulting frequency characteristics are primarily determined by the size of the conductor patch 32 that acts as a resonator. For this reason, there is reduced dependency on the distance from the conductor layer 22 to the short face of the hollow waveguide 4. As a result, the structure is resilient to the effects of irregularities in the positioning of the conductor patch 32 and the through-holes 40 for the conduction through-hole units 30.

(4) Since the conductor patch 32 is provided, it is possible to improve the signal conversion characteristics of the waveguide 8 constituting the post-wall waveguide, such characteristics being due to fabrication errors at the sites that lead signals to the hollow waveguide 4. In particular, the frequency dependence with respect to the signal conversion characteristics to the hollow waveguide 4 can be improved.

(5) The conductor patch 32 does not contact the conductor layer 22, and is disposed within a planar area equal to the aperture outline of the hollow waveguide 4. The length of this conductor patch 32 in the signal propagation direction may also be set to a value that corresponds to one-half the wavelength $\lambda$ (i.e., $\lambda/2$) of the high-frequency signals to be propagated. In so doing, the signal conversion characteristics can be improved.

(6) The sideways width of the conductor patch 32 is increased with respect to the signal travel direction. For this reason, the spacing between the two conduction through-hole arrays 26 and 28 that constitute the waveguide 8 of the conversion unit 10 can be set wider than the non-waveguide sites in the conversion unit 10. In so doing, the signal conversion characteristics can be improved.

Figure 13:
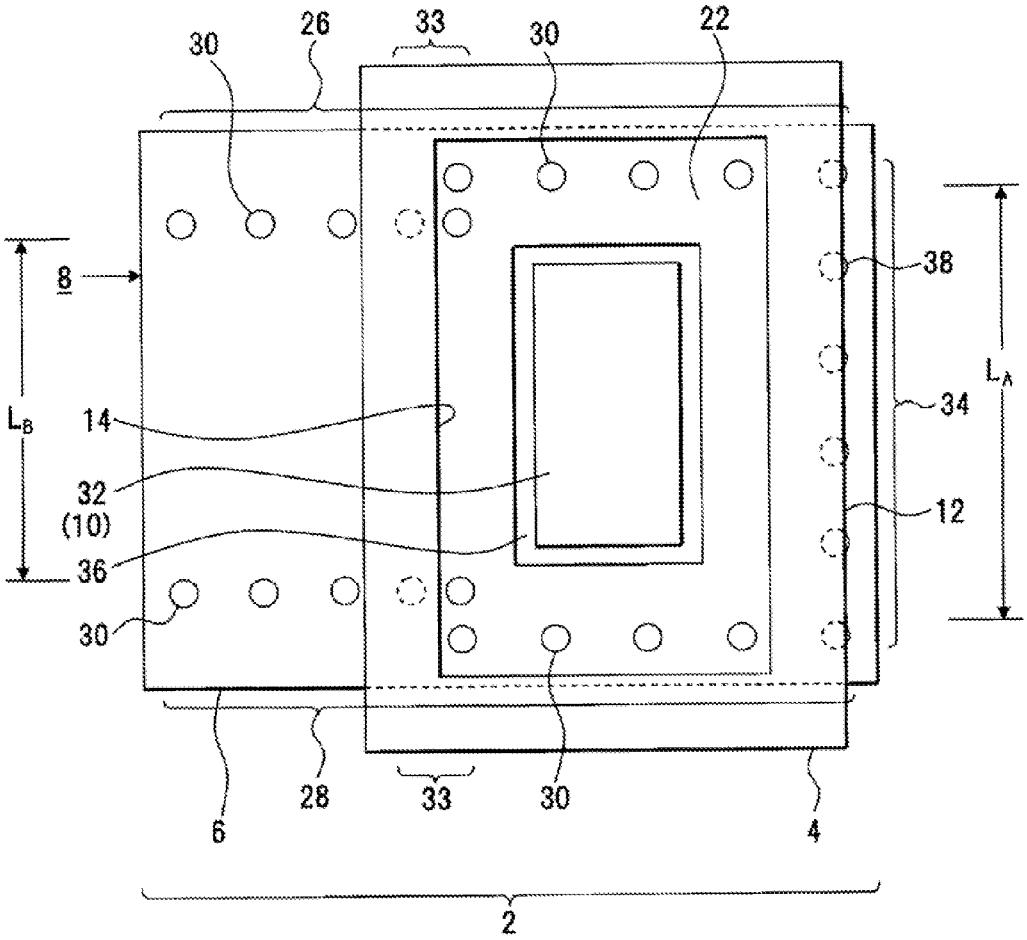
FIG. 13 illustrates an exemplary modification of the signal converter in accordance with the first embodiment.
Figure 14:
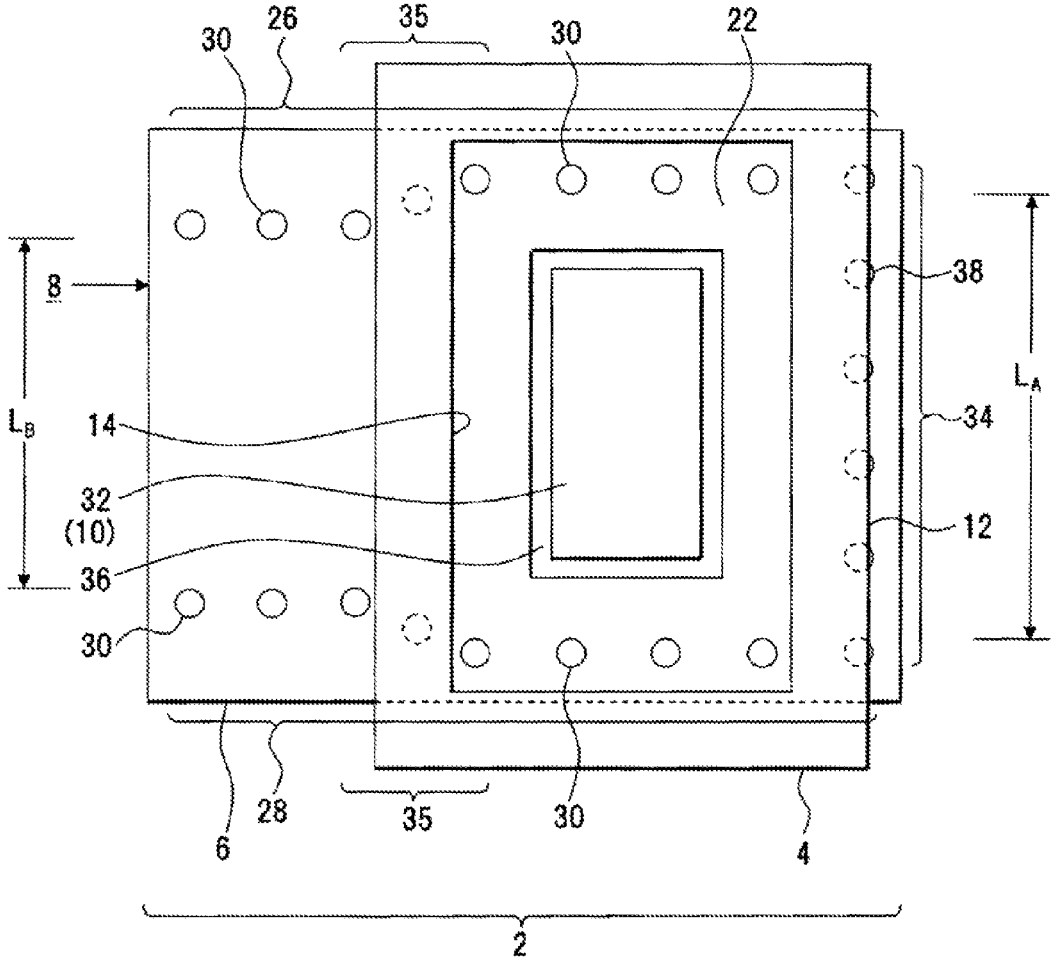
FIG. 14 illustrates an exemplary modification of the signal converter in accordance with the first embodiment.

Meanwhile, in some cases, it might be preferable to bring the width of the conductor patch 32 closer to the long-edge width $L_6$ of the hollow waveguide 4, so as to increase the bandwidth. In such cases, the conductor patch 32 might not fit unless the conduction through-hole width $L_7$ (or in other words, the width $L_5$ of the waveguide 8) is increased beyond one-half $\lambda_0/\epsilon_r^{1/2}$ described earlier (see, e.g., FIG. 10). In such cases, the spacing between opposing conduction through-hole units 30 that constitute the waveguide 8 may be varied. In other words, a step portion 33 (see FIG. 13) or a taper portion 35 (see FIG. 14) may be provided in the width $L_5$ of the waveguide 8, and set such that the spacing is reduced in the portion leading up to the conversion unit 10, and increased in the portion that encloses the conversion unit 10. In other words, as illustrated in FIGS. 13 and 14, the opposed spacing between the conduction through-hole arrays 26 and 28 may be set to $L_A$ on the side of the conversion unit 10, and set to $L_B$ for portions not corresponding to the conversion unit 10. The spacing values may be set such that $L_A > L_B$, and such that $L_A = L_5$. The above is acceptable where there is no misalignment in the positions of the conduction through-hole units 30 and the conductor patch 32. However, if the positions of the conduction through-hole units 30 and the conductor patch 32 of the conversion unit 10 are misaligned even slightly in the widthwise direction with respect to the travel direction of the waveguide 8, for example, then symmetry is broken, and may lead to the production of higher-order modes. If higher-order modes are produced, then energy will be expended at the higher-order modes, which leads to worsening of the signal conversion efficiency.

Second Embodiment

The second embodiment is configured such that a plurality of conduction through-hole units are provided between the conductor patch 32 and the conductor layer 24 of the first embodiment, with the conductor patch 32 and the conductor layer 24 being connected to each other by the conduction through-hole units.

Figure 15:
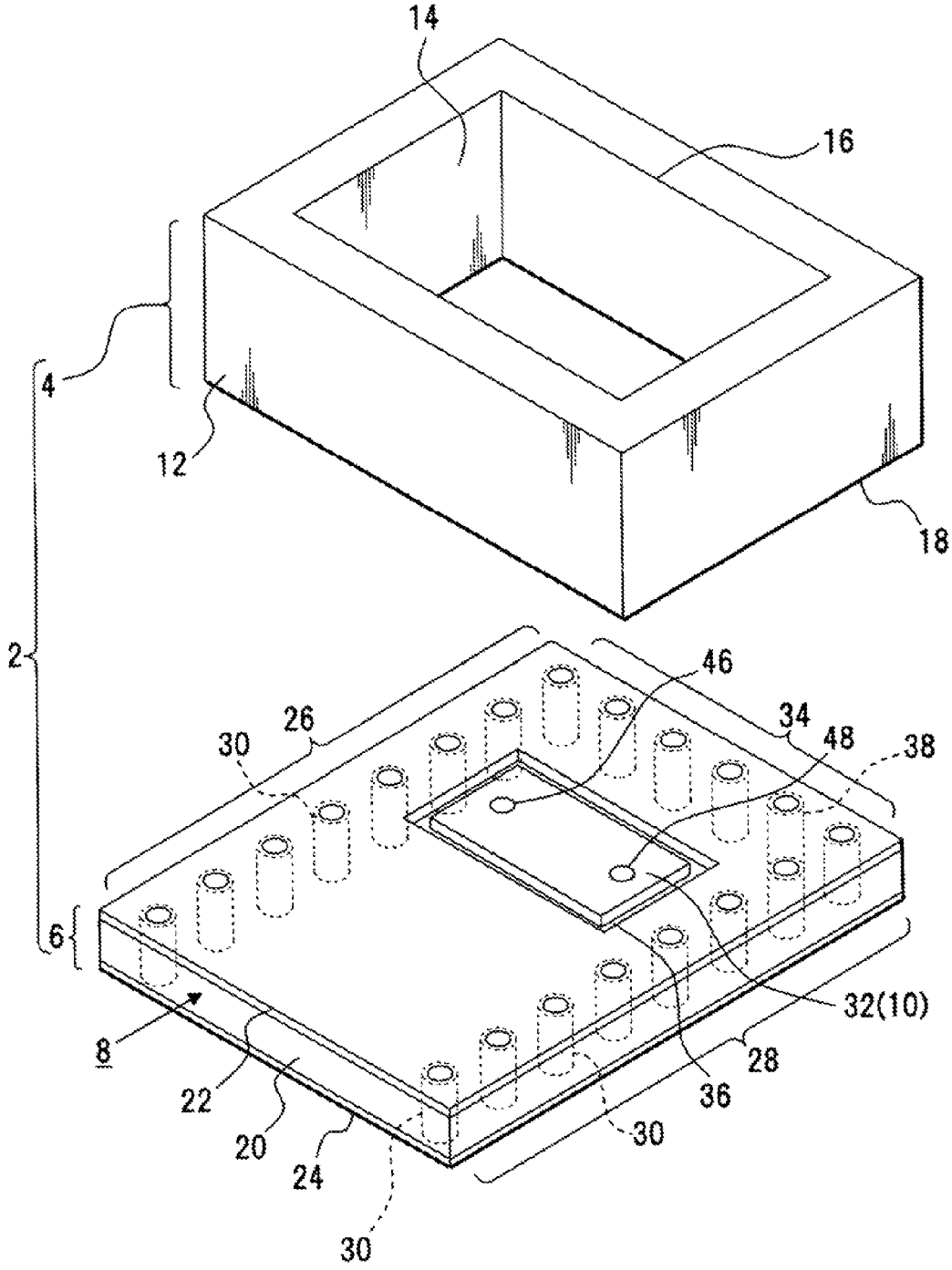
FIG. 15 is an exploded perspective view illustrating an exemplary hollow waveguide and waveguide substrate of a signal converter in accordance with a second embodiment.
Figure 16:
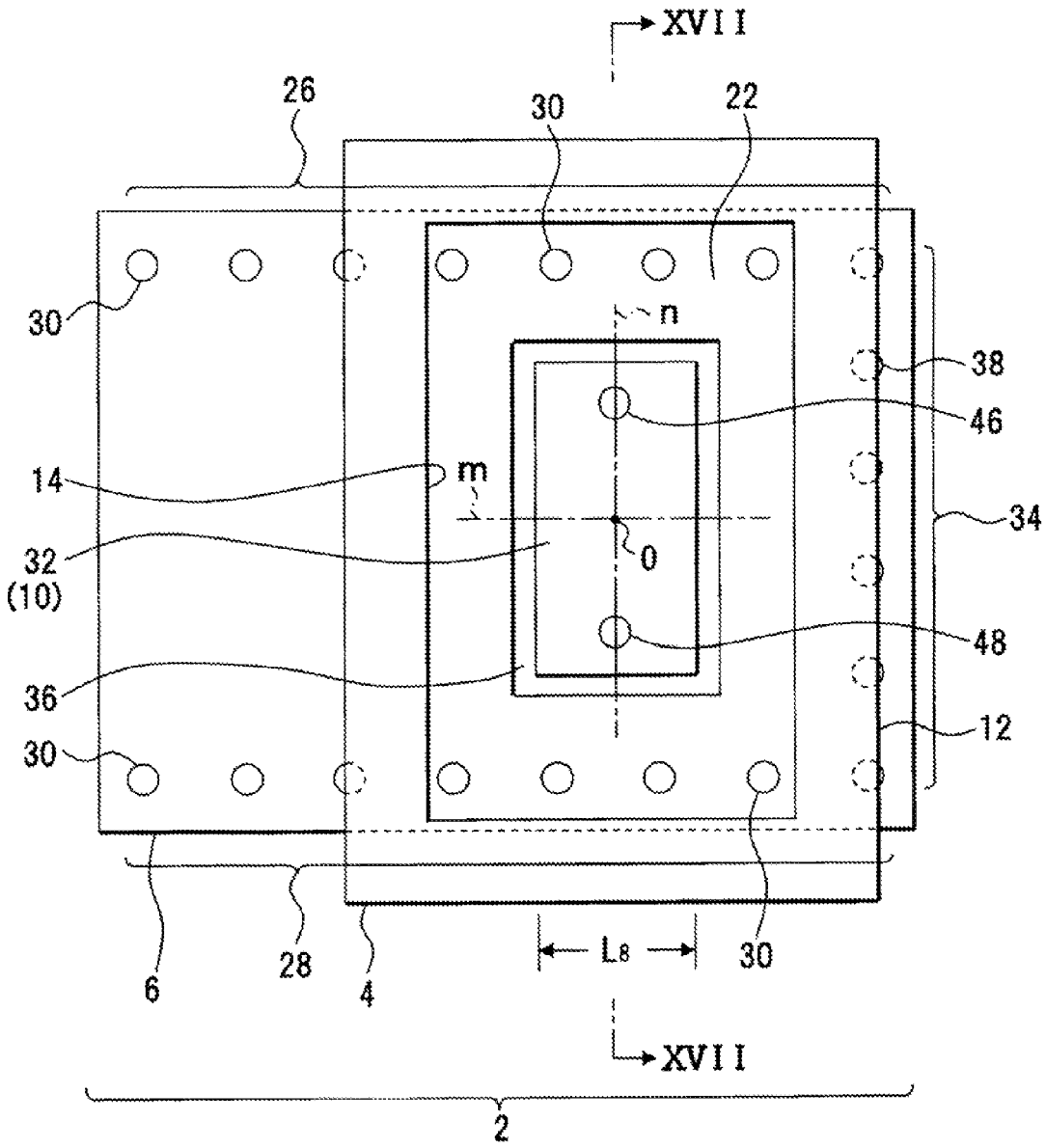
FIG. 16 illustrates an exemplary signal converter as viewed from a waveguide.
Figure 17:
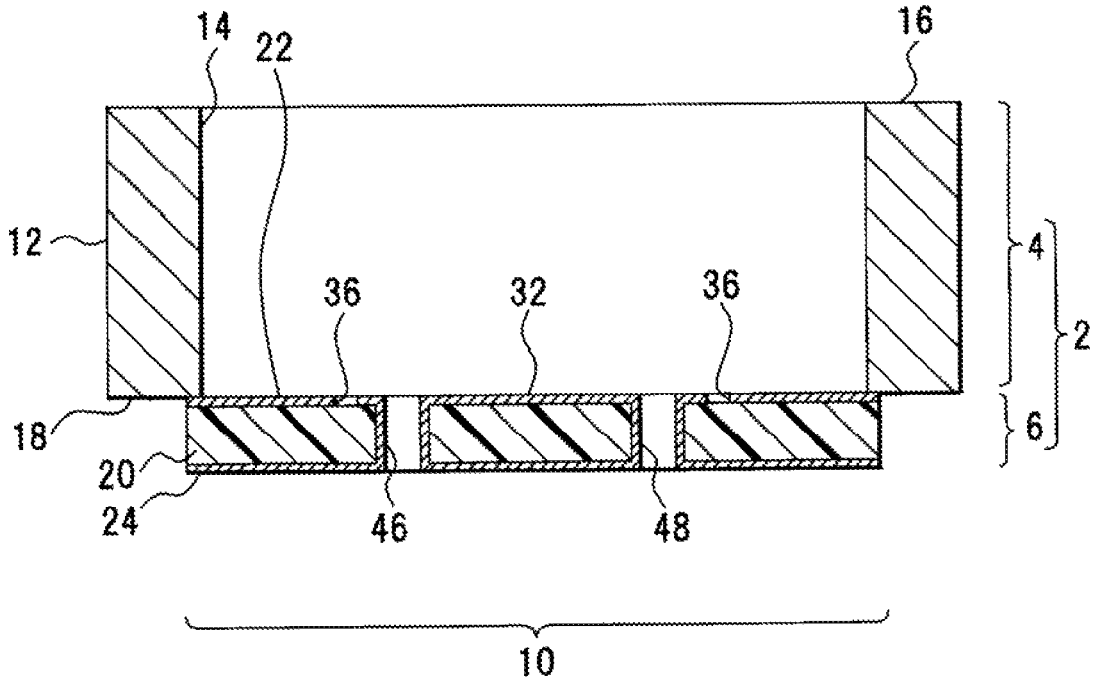
FIG. 17 is a cross section taken along the line XVII-XVII in FIG. 16.

The second embodiment will be described with reference to FIG. 15, FIG. 16, and FIG. 17. It should be appreciated that the configuration illustrated in FIG. 15, FIG. 16, and FIG. 17 is merely one example, and that the present invention is not limited to such a configuration. In FIG. 15, FIG. 16, and FIG. 17, identical reference numbers are used for portions identical to those in FIG. 2 and FIG. 3.

Similarly to the first embodiment, in the signal converter 2 of the present embodiment, the length $L_8$ of the conductor patch 32 in the waveguide mode travel direction (see FIG. 16) is set to one-half the signal wavelength λ (i.e., λ/2). The distance is set such that the node of a standing wave is forcibly generated on the line bisecting the conductor patch 32 in the above direction (i.e., the centerline). In this case, centerlines m and n are set intersecting at the center O of the conductor patch 32 (see, e.g., FIG. 16). Conduction through-hole units 46 and 48 are set on the centerline n. The conduction through-hole units 46 and 48 are spaced so as to be equidistant or nearly equidistant from the centerline m or the center O. In other words, the conduction through-hole units 46 and 48 are symmetrically disposed in the conductor patch 32 about the centerline in the travel direction of high-frequency signals. By use of the conduction through-hole units 46 and 48, the conductor layer 24 and the conductor patch 32 are connected (see, e.g., FIGS. 13 and 15).

According to such a configuration, the conduction through-hole units 46 and 48 are disposed at node positions. For this reason, their effects on the transmission of high-frequency signals is small, higher-order modes can be suppressed, and the fundamental resonance mode can be obtained. In other words, since the conductor patch 32 is shorted along its centerline by the conduction through-hole units 46 and 48, higher-order transmission (i.e., higher-order resonance) between the waveguide 8 (see, e.g., FIG. 15) and the conductor patch 32 can be suppressed. In so doing, signal conversion characteristics can be improved.

In addition, the two conduction through-hole units 46 and 48 in the conductor patch 32 should be spaced apart in the widthwise direction and not in close proximity to each other. The two conduction through-hole units 46 and 48 have an effect equivalent to reducing the width of the waveguide 8, and can increase the higher-order mode suppression effect.

It should also be appreciated that the number of conduction through-hole units 46 and 48 connecting the conductor patch 32 is not limited to one symmetric pair, and that a plurality of such pairs may be disposed, so long as the waveguide width is not made too narrow.

The conduction through-hole units 46 and 48 may be configured similarly to the conduction through-hole units 30, as illustrated in FIG. 11.

Third Embodiment

The third embodiment is configured such that a single conduction through-hole unit is provided between the conductor patch 32 and the conductor layer 24 of the first embodiment, with the conductor patch 32 and the conductor layer 24 being connected to each other by the conduction through-hole unit.

Figure 18:
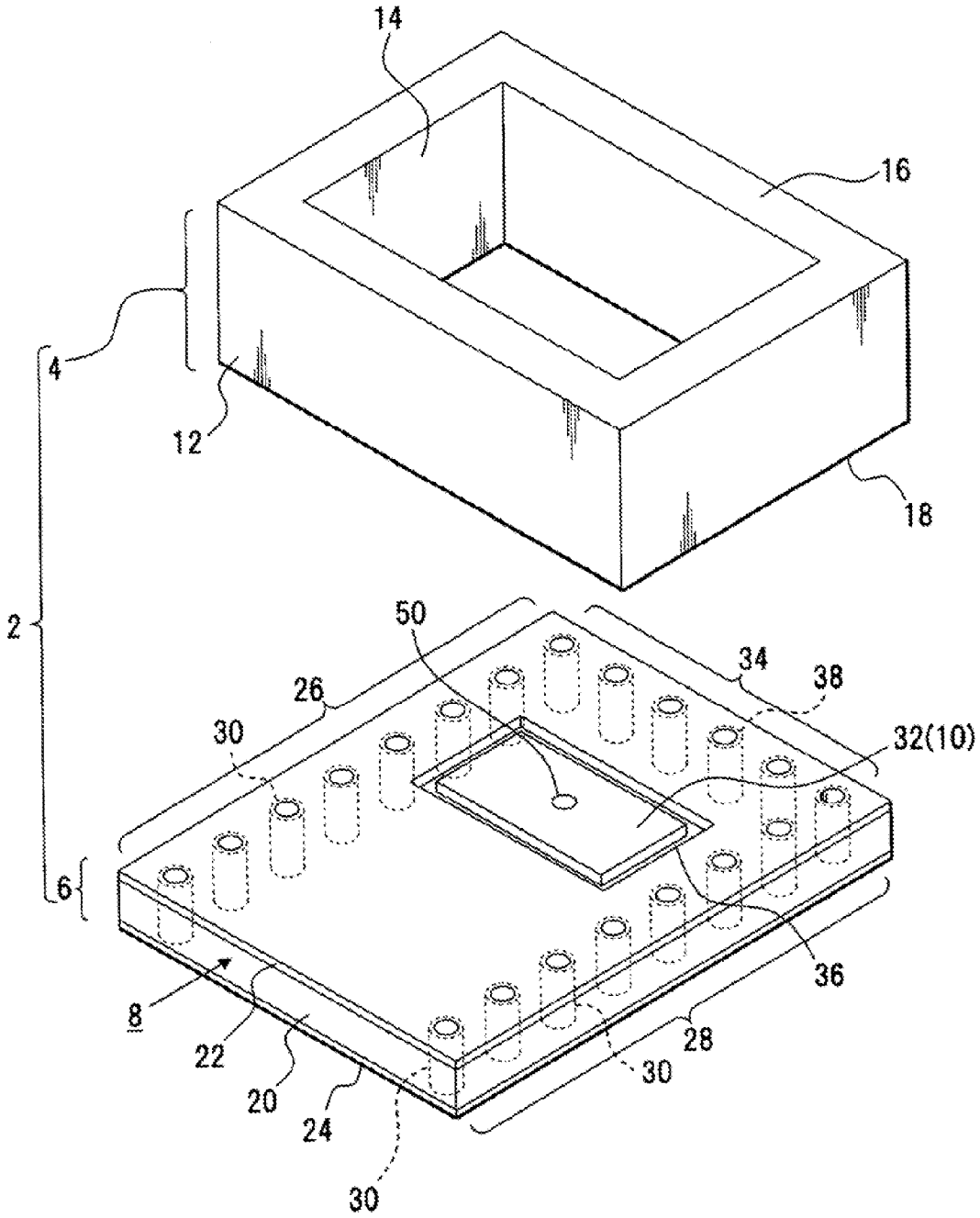
FIG. 18 is an exploded perspective view illustrating an exemplary hollow waveguide and the waveguide substrate of a signal converter in accordance with a third embodiment.
Figure 19:
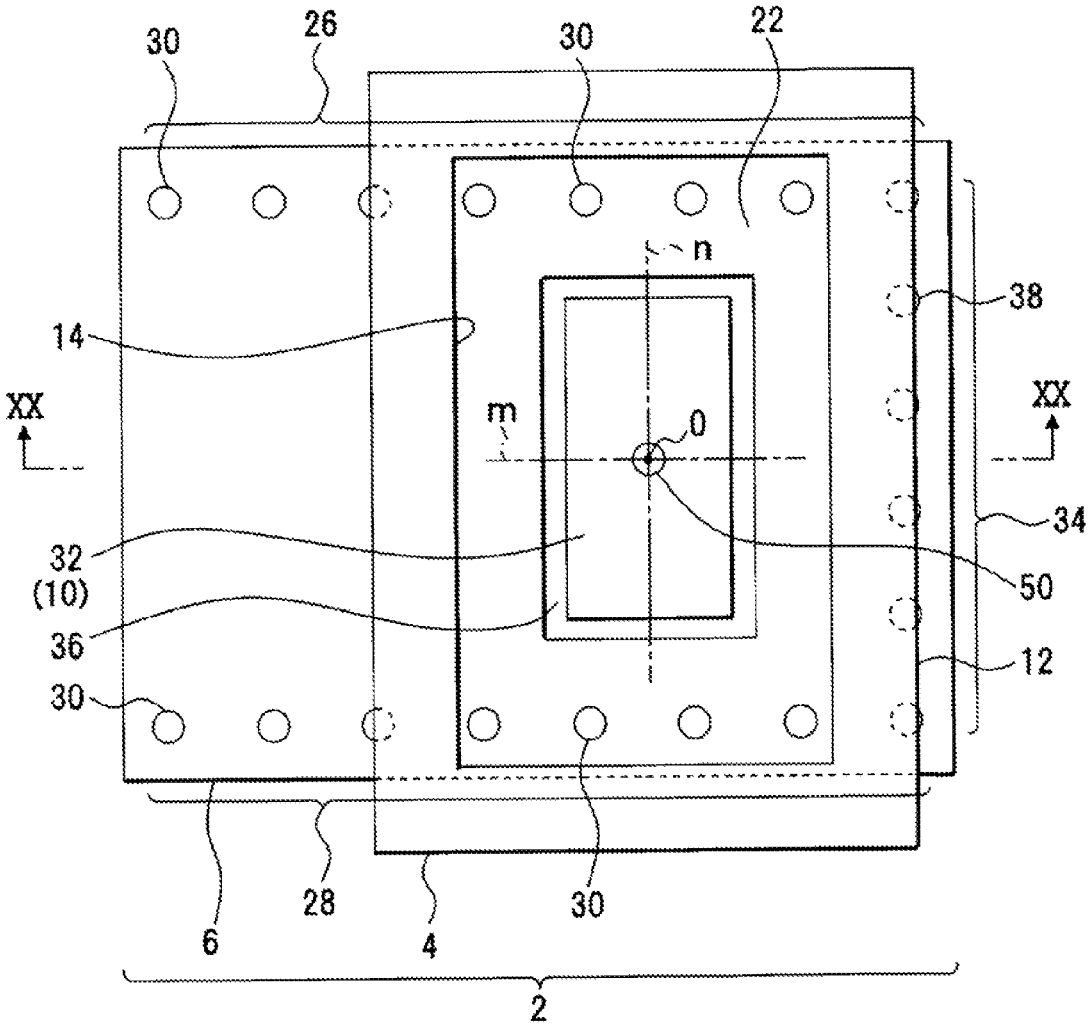
FIG. 19 illustrates an exemplary signal converter as viewed from a hollow waveguide.
Figure 20:
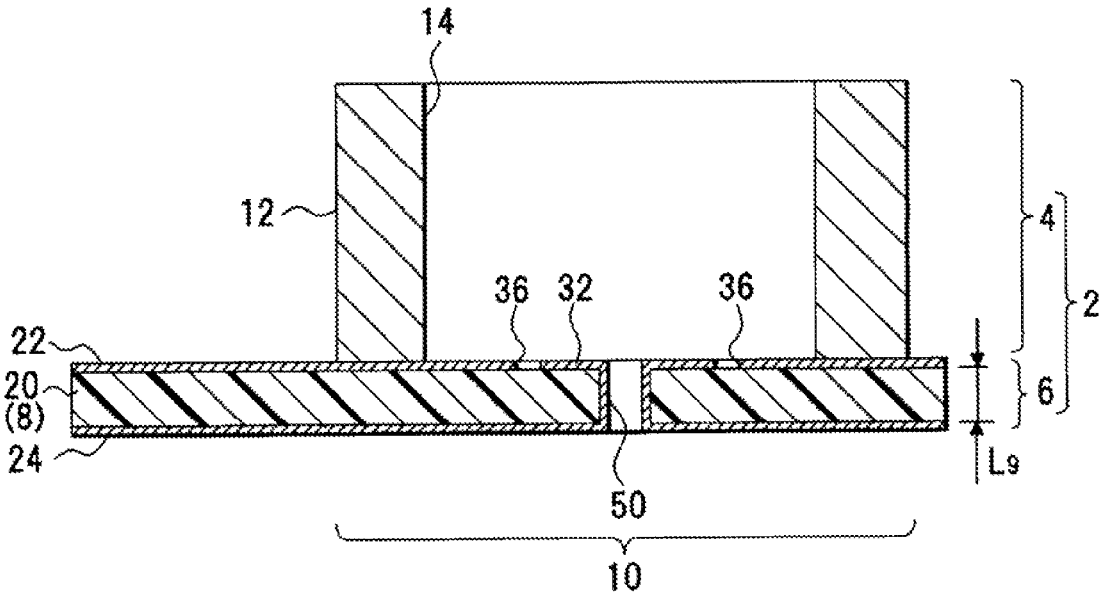
FIG. 20 is a cross section taken along the line XX-XX in FIG. 19.

The third embodiment will be described with reference to FIG. 18, FIG. 19, and FIG. 20. It should be appreciated that the configuration illustrated in FIG. 18, FIG. 19, and FIG. 20 is merely one example, and that the present invention is not limited to such a configuration. In FIG. 18, FIG. 19, and FIG. 20, identical reference numbers are used for portions identical to those in FIG. 15.

In this embodiment, a single conduction through-hole unit 50 connects the conductor patch 32. The conduction through-hole unit 50 is positioned in the center or near-center of the conductor patch 32, so that the center of the conductor patch 32 becomes a node, and higher-order modes are suppressed. In other words, centerlines m and n are set intersecting the center O of the conductor patch 32, and the conduction through-hole unit 50 is set at the intersection point of the centerlines m and n (i.e., at the center O), or at a position in the vicinity of the intersection point (see, e.g., FIG. 19). The length (i.e., depth) $L_9$ of the conduction through-hole unit 50 (see FIG. 20) is determined by the plate thickness of the waveguide substrate 6. Compared to the size of the conductor patch 32, the length $L_9$ of the conduction through-hole unit 50 is short. As a result, the connection position of the conductor patch 32 can be made into a node.

By disposing the conduction through-hole unit 50 in the center of the conductor patch 32 in this way, the basic advantages described earlier are obtained. Furthermore, since the center of the conductor patch 32 is shorted to the conductor layer 24 (see, e.g., FIGS. 18, 20) by the conduction through-hole unit 50, higher-order transmission (i.e., higher-order resonance) modes between the waveguide 8 and the conductor patch 32 can be suppressed.

Herein, the conduction through-hole unit 50 may be configured similarly to the conduction through-hole units 30 illustrated in FIG. 11.

Fourth Embodiment

The fourth embodiment is configured such that a connection unit is provided between the conductor patch 32 and the conductor layer 22.

Figure 21:
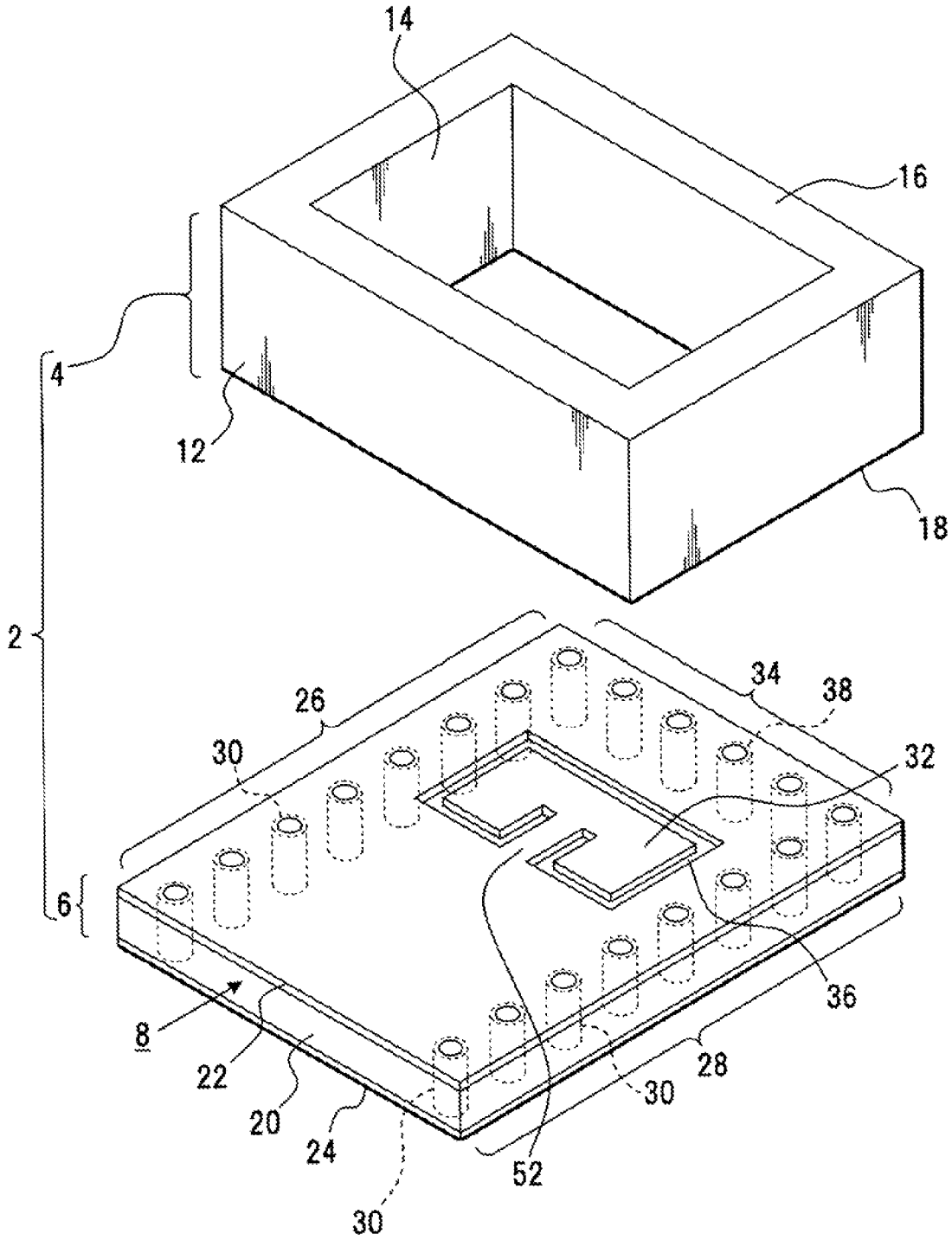
FIG. 21 is an exploded perspective view illustrating an exemplary hollow waveguide and the waveguide substrate of a signal converter in accordance with a fourth embodiment.
Figure 22:
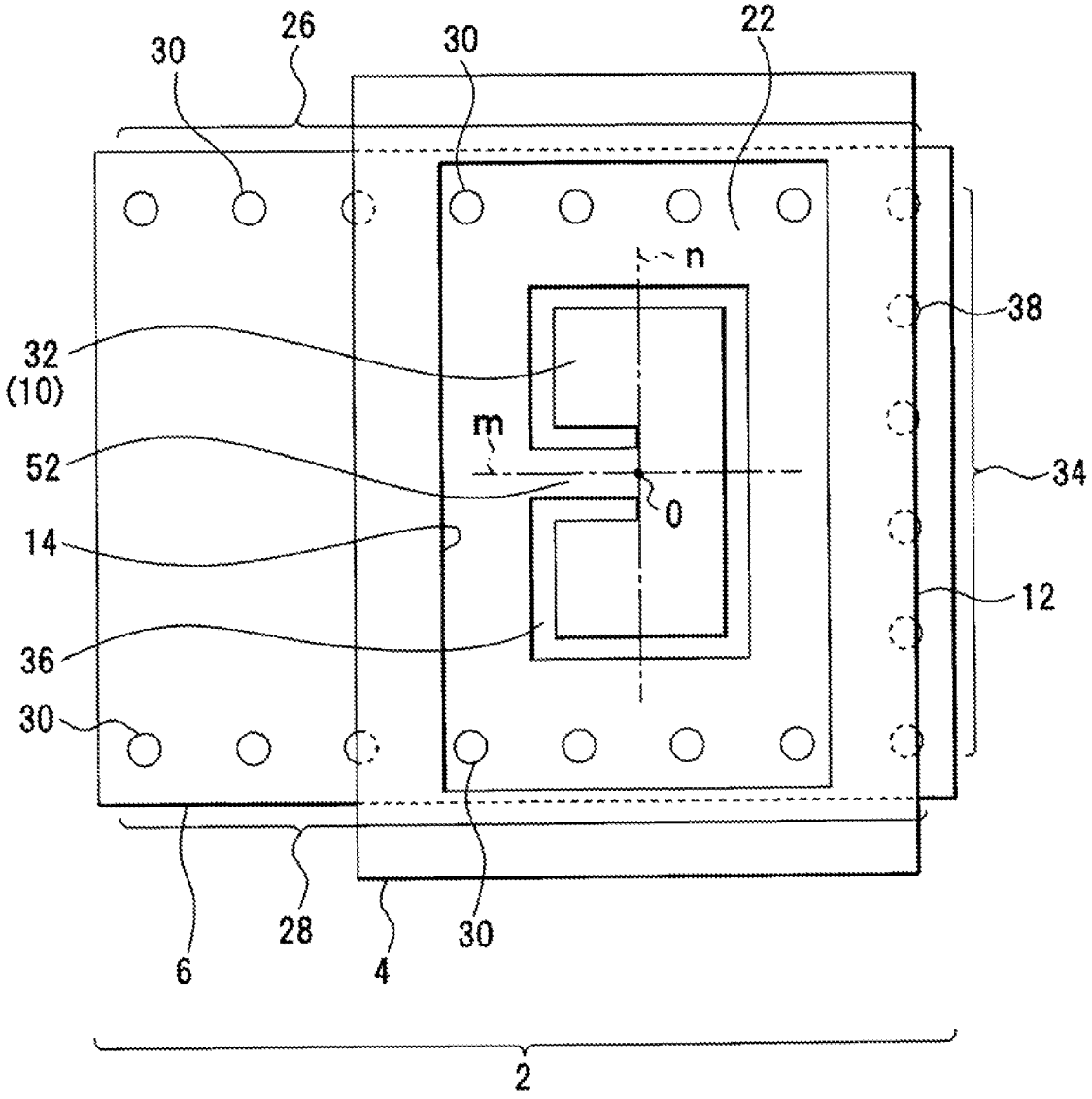
FIG. 22 illustrates an exemplary signal converter as viewed from a hollow waveguide.

The fourth embodiment will be described with reference to FIG. 21 and FIG. 22. It should be appreciated that the configuration illustrated in FIG. 21 and FIG. 22 is merely one example, and that the present invention is not limited to such a configuration. In FIG. 21 and FIG. 22, identical reference numbers are used for portions identical to those in FIG. 15.

As illustrated in FIG. 21 and FIG. 22, in the present embodiment, centerlines m and n (see, e.g., FIG. 22) are set intersecting at the center of the conductor patch 32. In addition, a first connection unit 52 as well as a separator region 36 sandwiching the connection unit 52 are formed centered about the centerline m. The connection unit 52 is one example of a connecting mechanism or connection region that connects the conductor patch 32 with the conductor layer 22. In the present embodiment, the connection unit 52 is formed in the center of the signal travel direction. In this case, the width of the connection unit 52 is set wider than the width of the separator region 36, while its length is set equal (or nearly equal) to the distance between the edge of the separator region 36 on the side of the conductor layer 22 and the centerline n (see, e.g., FIG. 22). The connection unit 52 may also be set longer so as to straddle the centerline n, or shorter so as to not straddle the centerline n. In the first through the third embodiments, the separator region 36 is a continuous unit that surrounds the conductor patch 32. In contrast, in the present embodiment, the separator region 36 is split by the formation of the connection unit 52.

In this way, the connection unit 52 is a mechanism for connecting the conductor patch 32 with the conductor layer 22, and is formed by a conductor extending from the waveguide 8 (see, e.g., FIG. 21) in the signal travel direction towards the hollow waveguide 4, up to the near edge of the conductor patch 32. The formation position is set at or near the center part of the conductor patch 32. In the present embodiment, the connection unit 52 is joined to the conductor patch 32 by splitting the junction gap with the near end in the travel direction of the waveguide 8 (i.e., by splitting the separator region 36). The connection unit 52 makes a conductive connection on the centerline n in the horizontal direction of the conductor patch 32. For this reason, a signal injection port is produced in a form according to the connecting conductor of the connection unit 52, and fundamental resonance in a form that maintains the horizontal symmetry of the conductor patch 32 can be obtained. In other words, a connection is made at a position close to where a node of the original standing wave would have been, rather than at a position where an antinode would have been. In other words, the connection position in the travel direction is no longer at the near edge of the conductor patch 32. In so doing, the fundamental resonance mode is maintained.

In addition, since the connection length and connection width is more finite than the surface conductor outside the conductor patch 32, then in consideration of the phase and the impedance, the connection position is slightly shifted away from the true center position of the conductor patch 32 in the travel direction. Hypothetically, if a connection were made at the near antinode, the connection would be affected by the shortness of the connection length and be changed into a connection point node, which would excite undesired higher-order modes. However, in the present embodiment, such inconveniences may be avoided or at least reduced. As a result, higher-order modes can be suppressed, and a structure resilient to misalignments in the positions of the conduction through-hole units 30 and the position of conductor patch 32 is configured without the use of conduction through-hole units that make conductive connections in order to suppress higher-order modes.

With such a configuration, the basic structure in accordance with the first embodiment is used, with the addition of a conductor patch 32 disposed in connection with the connection unit 52 at the edge of the same planar area as the center of the near edge in the travel direction of waveguide modes within the substrate. The characteristic signal conversion structure is achieved. For this reason, the basic advantages of the first embodiment are obtained, while in addition, higher-order transmission (i.e., higher-order resonance) modes between the waveguide within the substrate and the conductor patch 32 can be suppressed.

Moreover, the above structure is configured such that a portion of the conductor patch 32 is removed, and such that the connection point between the conductor patch 32 and the surrounding conductor layer 22 is moved from the periphery and provided farther inward from the edge of the conductor patch 32. With such a structure, higher-order modes can be suppressed without through-holes for constraining higher-order resonance. Since there are no through-hole units in the center part of the conductor patch 32, positioning of that part can be omitted, thereby making it possible to reduce costs.

Fifth Embodiment

The fifth embodiment is configured such that the conductor patch 32 and the conductor layer 22 are connected by two connection units provided between the conductor patch 32 and the waveguide 8 in an intersecting direction, such as orthogonally.

Figure 23:
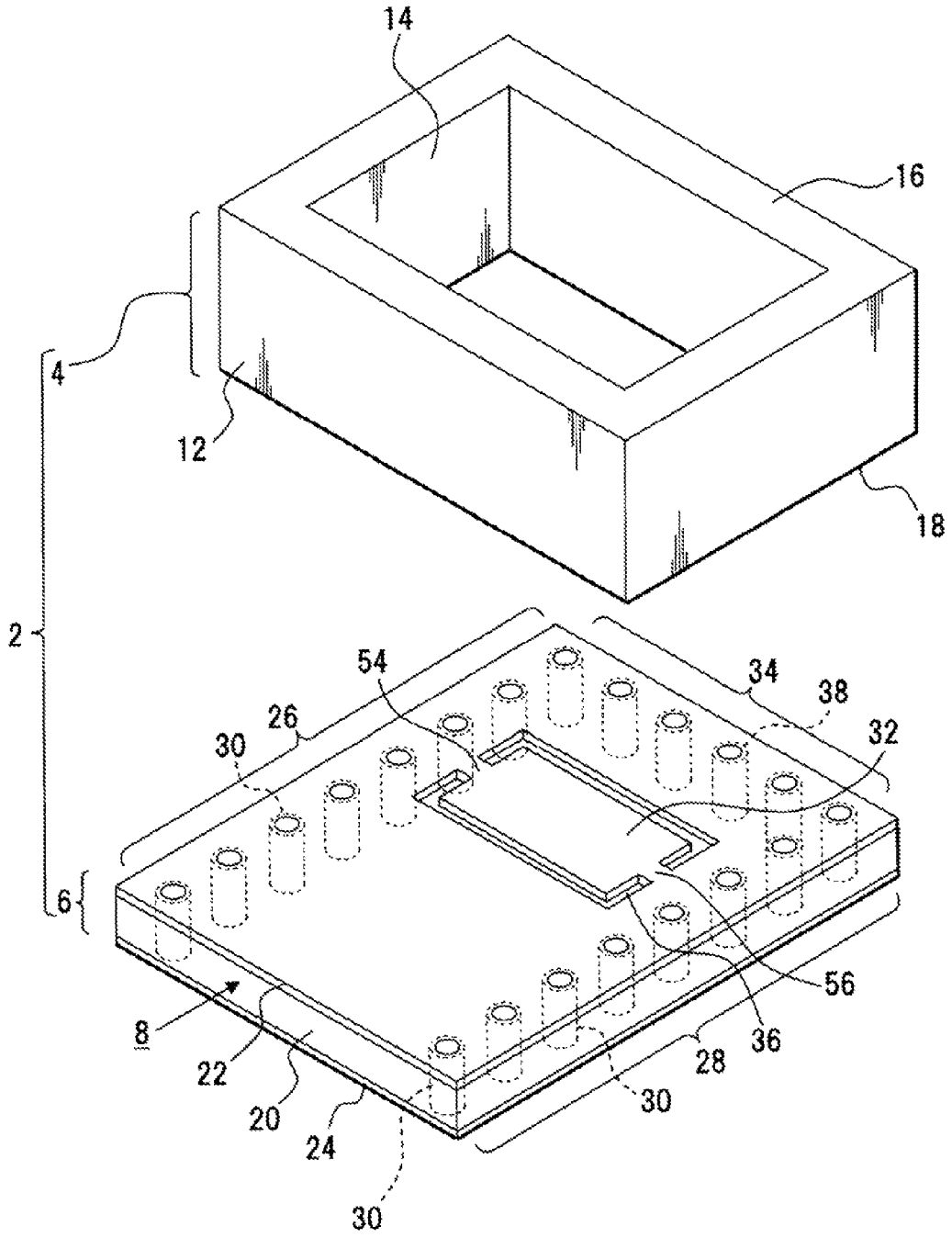
FIG. 23 is an exploded perspective view illustrating an exemplary hollow waveguide and waveguide substrate of a signal converter in accordance with a fifth embodiment.
Figure 24:
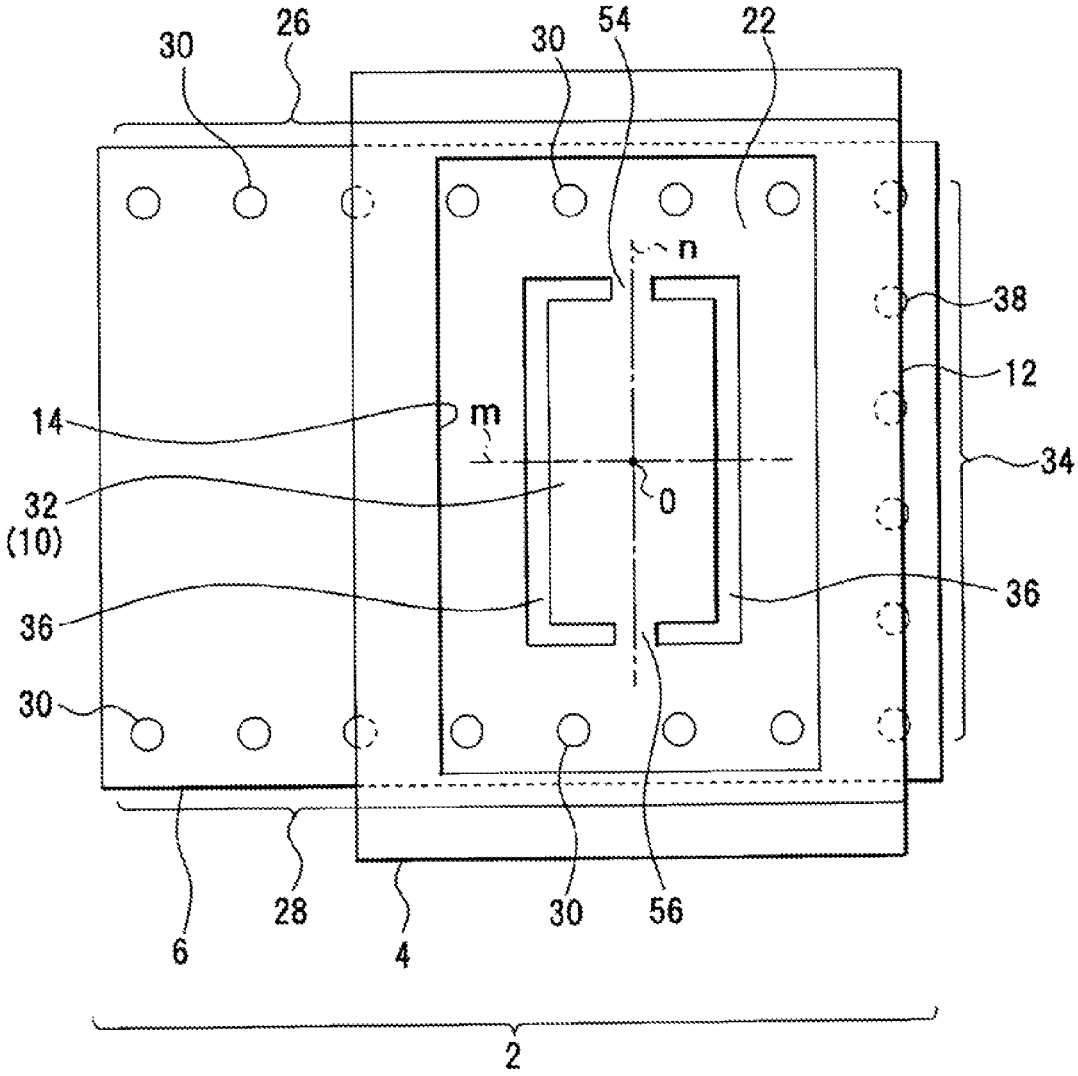
FIG. 24 illustrates an exemplary signal converter as viewed from a hollow waveguide.

The fifth embodiment will be described with reference to FIG. 23 and FIG. 24. It should be appreciated that the configuration illustrated in FIG. 23 and FIG. 24 is merely one example, and that the present invention is not limited to such a configuration. In FIG. 23 and FIG. 24, identical reference numbers are used for portions identical to those in FIG. 15.

As illustrated in FIG. 23 and FIG. 24, in the present embodiment, centerlines m and n are set intersecting at the center O of the conductor patch 32 (see, e.g., FIG. 24). In addition, second connection units 54 and 56 that split the separator region 36 are formed at positions on or near the centerline n for the horizontal direction. In other words, the connection units 54 and 56 are formed at positions at or near the halfway point of the conductor patch 32 in the travel direction. The connection units 54 and 56 mimic a conductor similar to the conductor layer 22 that conducts from the conductor patch 32 to the conductor layer 22 in the horizontal direction. The connection units 54 and 56 are one example of a connecting mechanism or a connection region that connects the conductor patch 32 with the conductor layer 22 at the edge of the conductor patch 32. The connection length of each of the connection units 54 and 56 are set shorter than the length of the conductor patch 32 so as to reduce fluctuations in electric potential, while the connection widths are set small compared to the width of the conductor patch 32 in the travel direction.

With such a configuration, a standing wave node can be maintained at the halfway position of the conductor patch 32 in the travel direction. In other words, the fundamental resonance mode can be maintained, and higher-order modes can be suppressed. In addition, the connecting conductor that makes a connection with the conductor patch 32 in order to suppress higher-order modes is formed by a conductor similar to the conductor layer 22. With such a configuration, it becomes possible to suppress higher-order modes even given misalignment in the position of the conductor patch 32 with respect to the positions of the conduction through-hole units 30. As a result, a structure more resilient to positional misalignments of the conductor patch 32 is realized.

The position on the waveguide 8 where the maximum electric field strength occurs is along the widthwise centerline in the widthwise direction with respect to the travel direction of the waveguide 8 (see, e.g., FIG. 23). If the conductor patch 32 is misaligned with respect to the positions of the conduction through-hole units 30 at the time of manufacturing, the position where the maximum electric field strength occurs becomes a site shifted off the center position of the conductor patch 32 in the widthwise direction. In this case, the site shifted off the center position of the conductor patch 32 (i.e., the resonator) in the widthwise direction is excited via the junction gap. If the length of the conductor patch 32 in the widthwise direction is large enough to potentially produce higher-order modes, then higher-order modes are produced. In the present embodiment, such inconveniences can be reduced.

Sixth Embodiment

The sixth embodiment is a combination of the fourth and the fifth embodiments.

Figure 25:
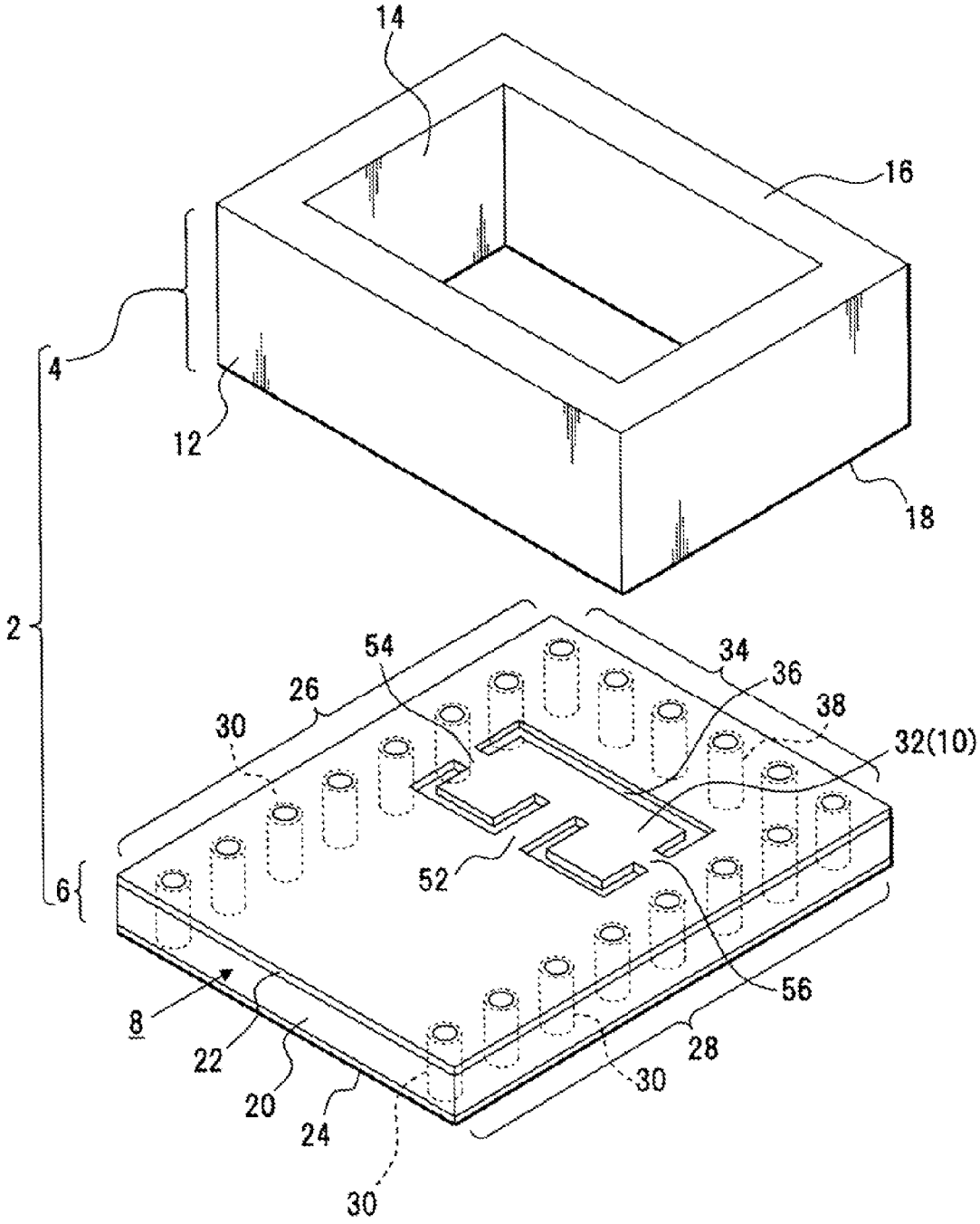
FIG. 25 is an exploded perspective view illustrating an exemplary hollow waveguide and the waveguide substrate of a signal converter in accordance with a sixth embodiment.
Figure 26:
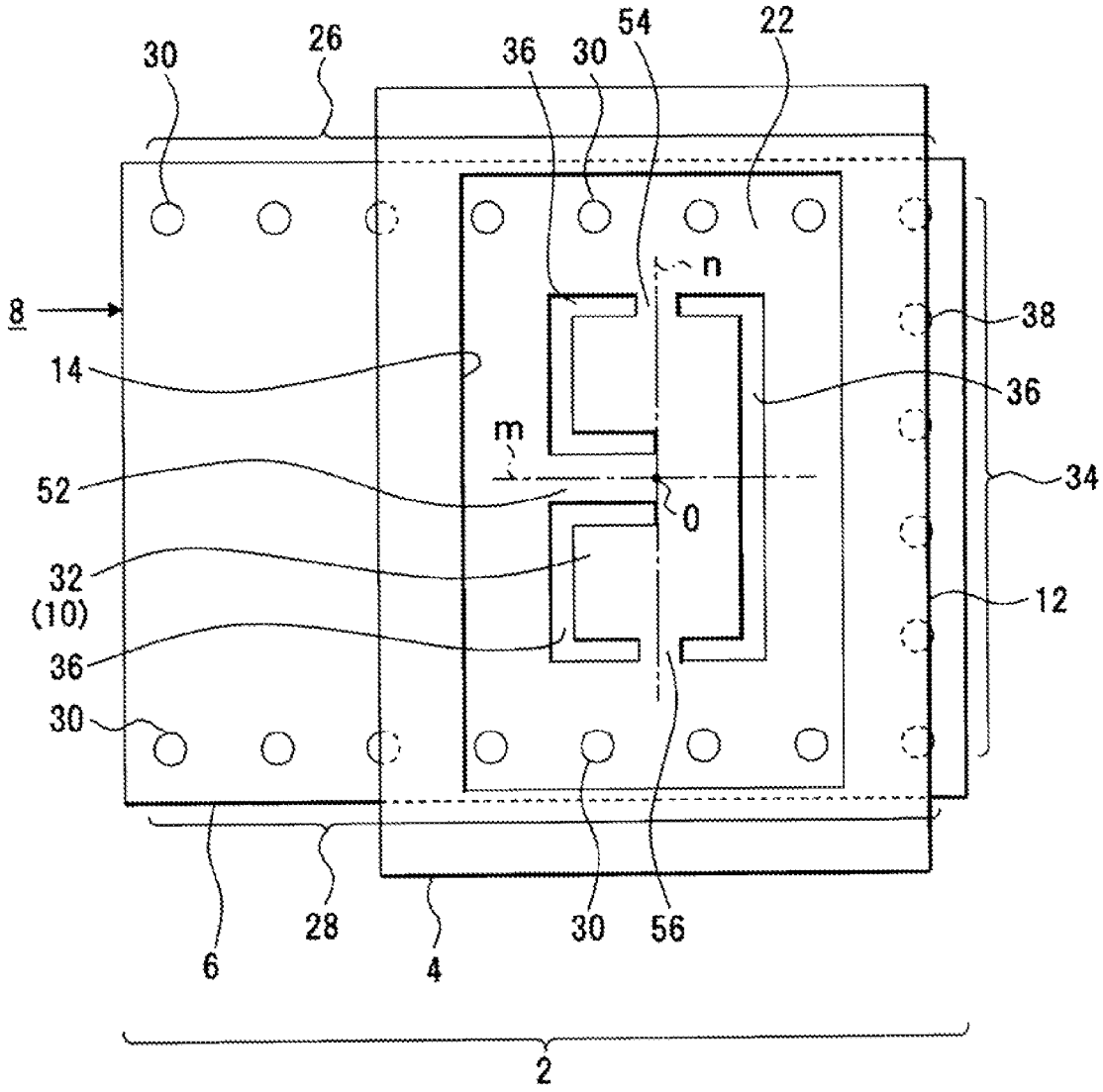
FIG. 26 illustrates an exemplary signal converter as viewed from a hollow waveguide.

The sixth embodiment will be described with reference to FIG. 25 and FIG. 26. It should be appreciated that configuration illustrated in FIG. 25 and FIG. 26 is merely one example, and that the present invention is not limited to such a configuration. In FIG. 25 and FIG. 26, identical reference numbers are used for portions identical to those in FIG. 21 or FIG. 23.

In the present embodiment, the first connection unit 52 of the fourth embodiment (see FIG. 21) is formed between the conductor patch 32 and the conductor layer 22 on or near the centerline m. In addition, the second connection units 54 and 56 of the fifth embodiment (see FIG. 23) are formed between the conductor patch 32 and the conductor layer 22 on or near the centerline n (see, e.g., FIG. 26). In a signal converter 2 provided with the three connection sites of the connection units 52, 54, and 56 connecting the conductor patch 32 with the conductor layer 22, a structure combining the embodiments described earlier is realized. For this reason, the higher-order mode suppression advantages obtained in both the fourth and fifth embodiments are obtained.

In the present embodiment, the primary resonator is the conductor patch 32, similar to that described in the first embodiment (see FIG. 2 and thereafter). The relative influence is lowered for the standing wave produced in the distance (i.e., gap) between the short wall made up of the blocking conduction through-hole array 34, and the edge of the conductor patch 32 on the side of the short wall. In other words, the relative effectiveness is lowered for the standing wave in the distance between the edge of the conductor patch 32 in the travel direction of the waveguide 8 in the waveguide substrate 6, and the blocking conduction through-hole array 34. For this reason, when compared to the example of the related art wherein the distance to the short wall influenced the signal conversion characteristics, that influence has been reduced. Thus, a structure is realized that is less susceptible to the effects of positioning irregularities among the conduction through-hole arrays 26 and 28, the conductor layers 22 and 24, and the conductor patch 32. Consequently, the waveguide substrate 6 and the signal converter 2 have a larger allowable error with respect to positioning, have excellent conversion characteristics, and their manufacturing costs can be reduced.

In addition, in the present embodiment, the connection units 52, 54, and 56 that make a connection with the conductor layer 22 are provided on two lateral edges of the conductor patch 32 with respect to the travel direction of waveguide modes within the substrate. For this reason, the conductor layer 22 is connected with the middle regions on the periphery of the conductor patch 32. In this way, by providing short points in the form of the lateral connection units 54 and 56 in addition to the connection unit 52, higher-order transmission (i.e., higher-order resonance) modes between the waveguide 8 and the conductor patch 32 can be suppressed, even if the conductor patch 32 is increased in size.

Seventh Embodiment

The seventh embodiment is configured having a plurality of both conduction through-hole arrays as well as blocking conduction through-hole arrays.

Figure 27:
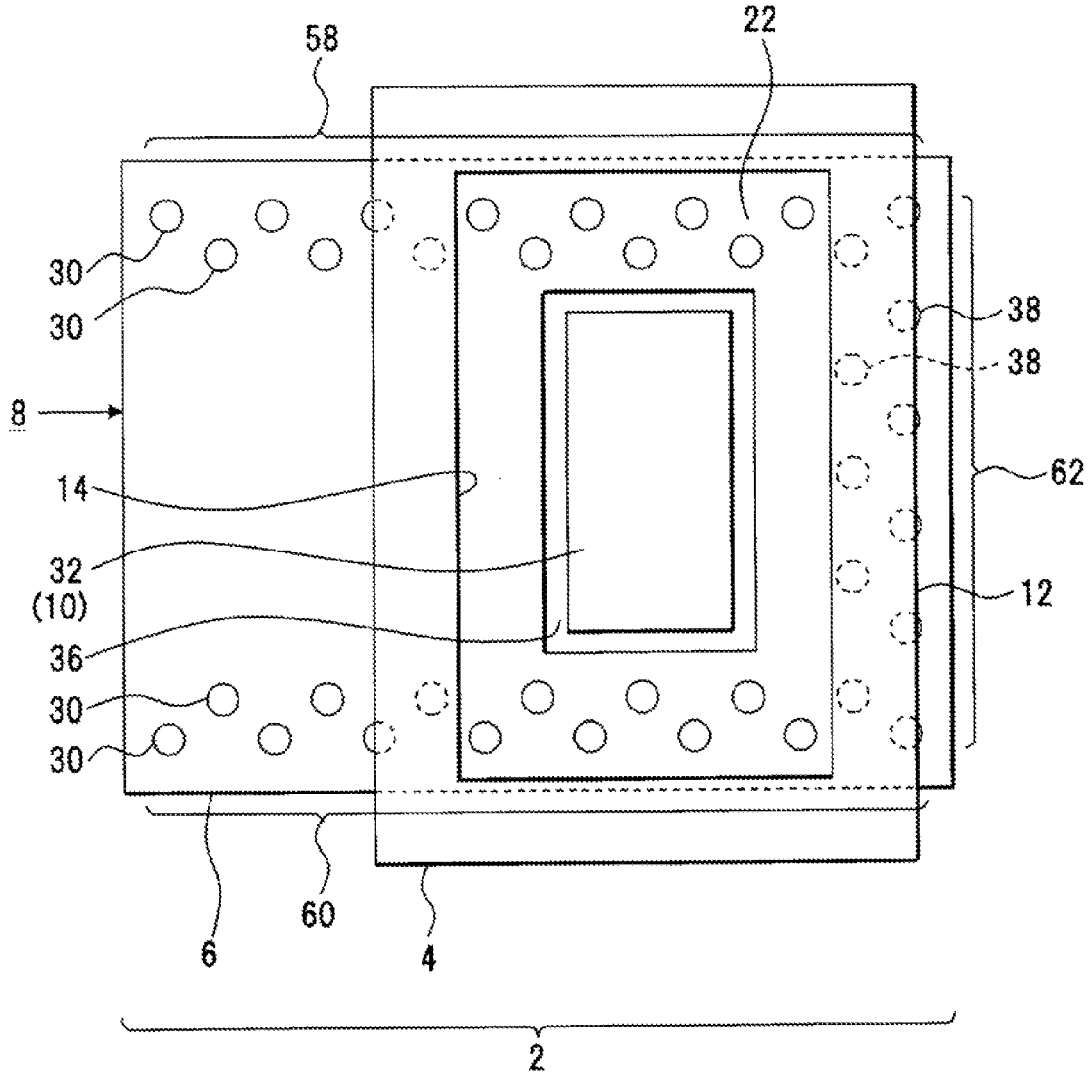
FIG. 27 illustrates an exemplary signal converter in accordance with a seventh embodiment.

The seventh embodiment will be described with reference to FIG. 27. It should be appreciated that the configuration illustrated in FIG. 27 is merely one example, and that the present invention is not limited to such a configuration. In FIG. 27, identical reference numbers are used for portions identical to those in FIG. 10.

As illustrated in FIG. 27, in the present embodiment, the conduction through-hole arrays 26 and 28 as well as the blocking conduction through-hole array 34 described earlier (see, e.g., FIG. 10) are now configured as two-row conduction through-hole arrays 58 and 60 as well as a two-row blocking conduction through-hole array 62. It should be appreciated that the two-row arrays herein are merely one example, and that arrays of three rows or more may also be configured. By introducing plural-row arrays in this way, the magnitude of signal leakage can be decreased.

In this case, the spacing between respective conduction through-hole units 30 or respective blocking conduction through-hole units 38 on individual rows are set substantially identically. In addition, in the spacing portions on each row, another row of conduction through-hole units 30 or blocking conduction through-hole units 38 may be disposed in a staggered configuration. In so doing, advantages are obtained that are equivalent to narrowing the spacing between respective conduction through-hole units 30 or blocking conduction through-hole units 38.

Eighth Embodiment

The eighth embodiment is configured such that the through-holes for the conduction through-hole units 30 and the blocking conduction through-hole units 38 are embedded in the conductor layer and configured as through conductors (i.e., conduction posts).

Figure 28:
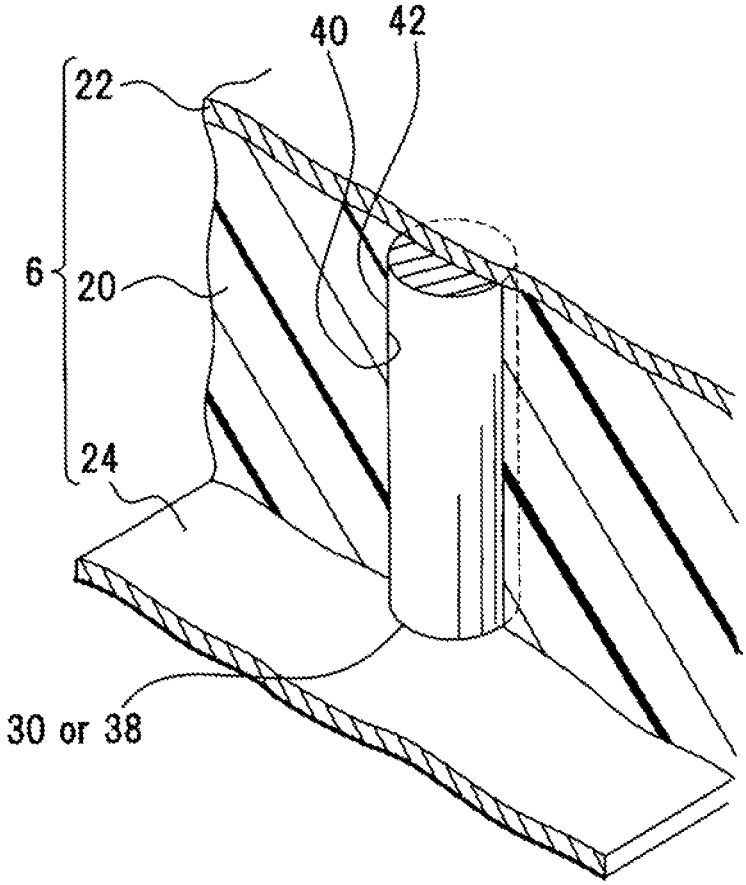
FIG. 28 illustrates an exemplary waveguide substrate from which a conduction through-hole portion has been cut out, in accordance with an eighth embodiment.

The eighth embodiment will be described with reference to FIG. 28. In FIG. 28, identical reference numbers are used for portions identical to those in FIG. 11.

In this case, the conduction through-hole units 30 are configured as follows. The through-holes 40 are formed penetrating the dielectric substrate 20, and the conductor layer 42 is embedded into the through-holes 40, thereby realizing conduction posts in the form of cylindrical through conductors as a result of the conductor layer 42. Such conduction through-hole units 30 may be used in the conduction through-hole arrays 26 and 28 described earlier (see, e.g., FIG. 27). Since microwaves and EHF waves strongly exhibit the skin effect, advantages equivalent to those of the foregoing embodiments can be obtained, even when such conduction through-hole units 30 are used.

In addition, the blocking conduction through-hole units 38 may be similarly configured as follows. The through-holes 40 are formed penetrating the dielectric substrate 20, and the conductor layer 42 is embedded into the through-holes 40, thereby realizing cylindrical through conductors as a result of the conductor layer 42. Besides being cylindrical, the conductor layer 42 may also be a prismoid. Such blocking conduction through-hole units 38 may be used in the blocking conduction through-hole array 34 described earlier (see, e.g., FIG. 10). Since microwaves and EHF waves strongly exhibit the skin effect, advantages equivalent to those of the foregoing embodiments can be obtained, even when such blocking conduction through-hole units 38 are used.

Ninth Embodiment

The ninth embodiment is configured such that the conduction through-hole arrays 26 and 28 as well as the blocking conduction through-hole array 34 are configured as a conductor wall.

Figure 29:
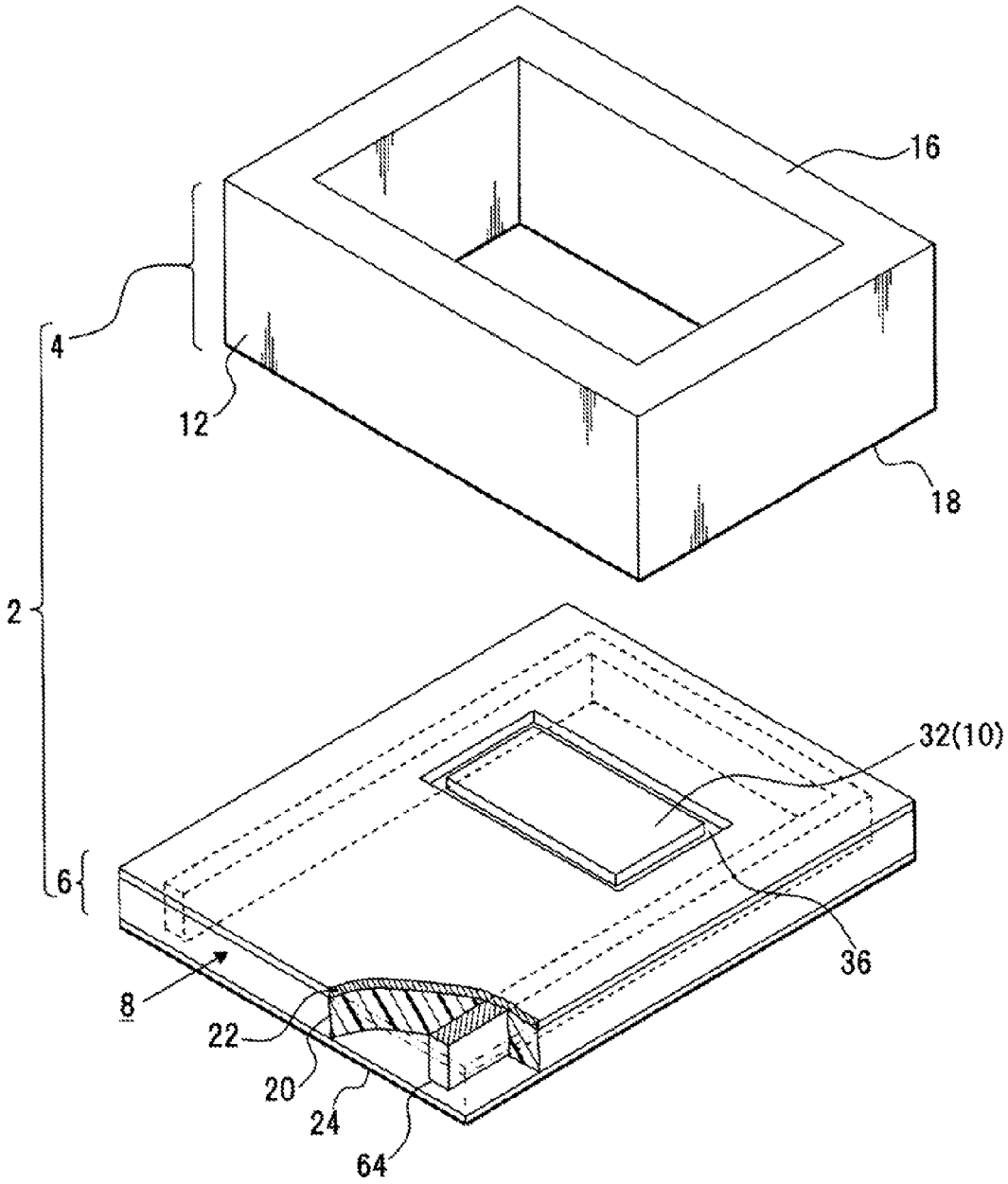
FIG. 29 is an exploded perspective view illustrating an exemplary hollow waveguide and the waveguide substrate of a signal converter in accordance with a ninth embodiment.

The ninth embodiment will be described with reference to FIG. 29. FIG. 29 is an exploded perspective view illustrating a partially cut-out waveguide substrate of a signal converter. In FIG. 29, identical reference numbers are used for portions identical to those in FIG. 3.

Since the conduction through-hole arrays 26 and 28 or the blocking conduction through-hole array 34 is a mechanism for realizing a conductor wall, the above arrays are not limited to the conduction through-hole units 30 or the blocking conduction through-hole units 38, and need not be arrays of through-holes. As illustrated in FIG. 29, the conduction through-hole arrays 26 and 28 or the blocking conduction through-hole array 34 described earlier (see, e.g., FIG. 10) may be realized as a unified conductor wall 64, and configured such that the conductor layers 22 and 24 are connected to each other by the conductor wall 64. In the present embodiment, an internal waveguide is realized inside the dielectric substrate 20 by the conductor wall 64 as well as the conductor layers 22 and 24, with a dielectric material being enveloped inside the waveguide. Advantages equivalent to those of the foregoing embodiments can be obtained, but since there are no spacing portions as with the conduction through-hole arrays 26 and 28 as well as the blocking conduction through-hole array 34, leakage on the side of the waveguide 8 can be further suppressed.

Other Embodiments

Figure 30:
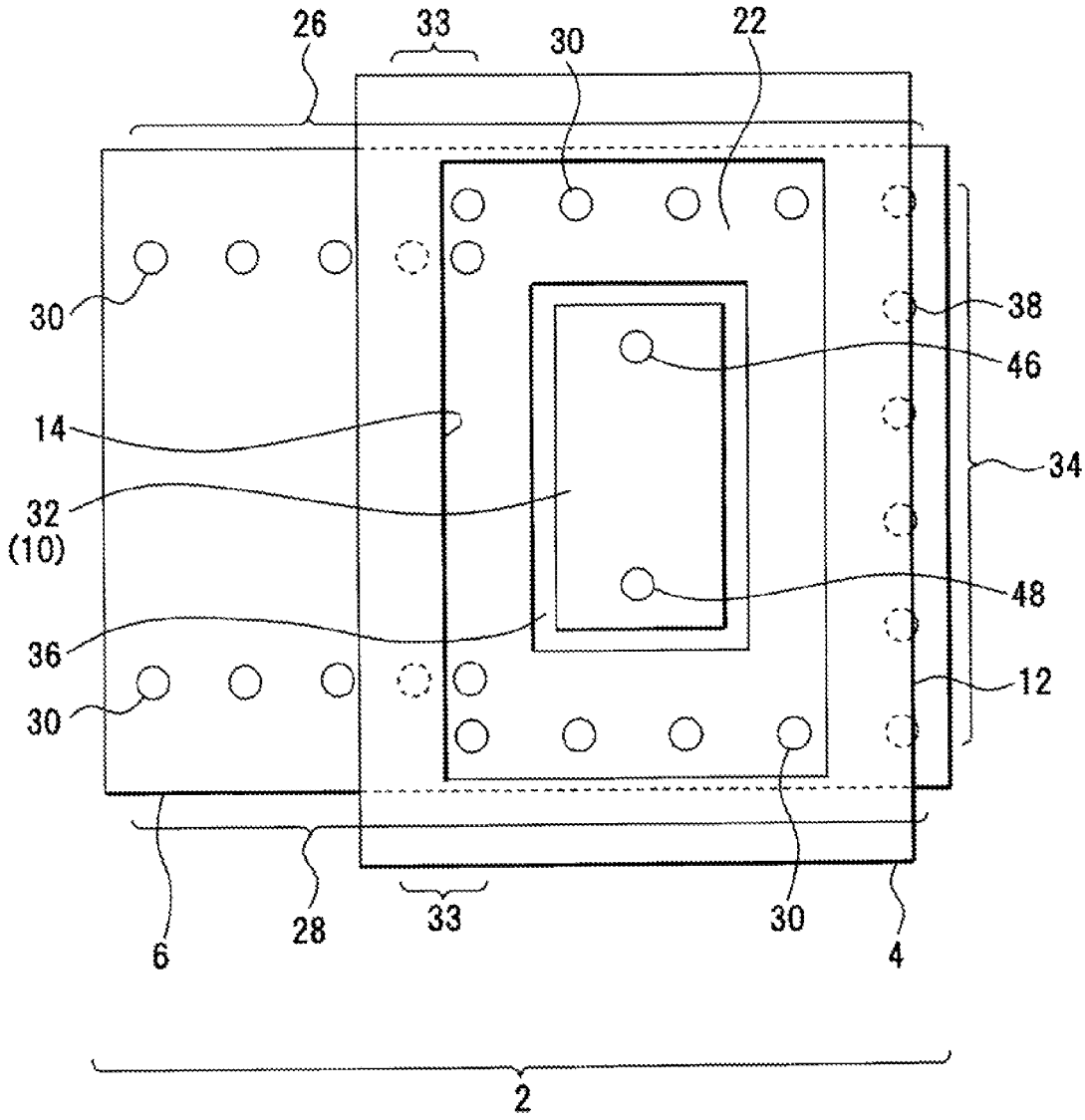
FIG. 30 illustrates an exemplary modification of a signal converter in accordance with another embodiment.
Figure 31:
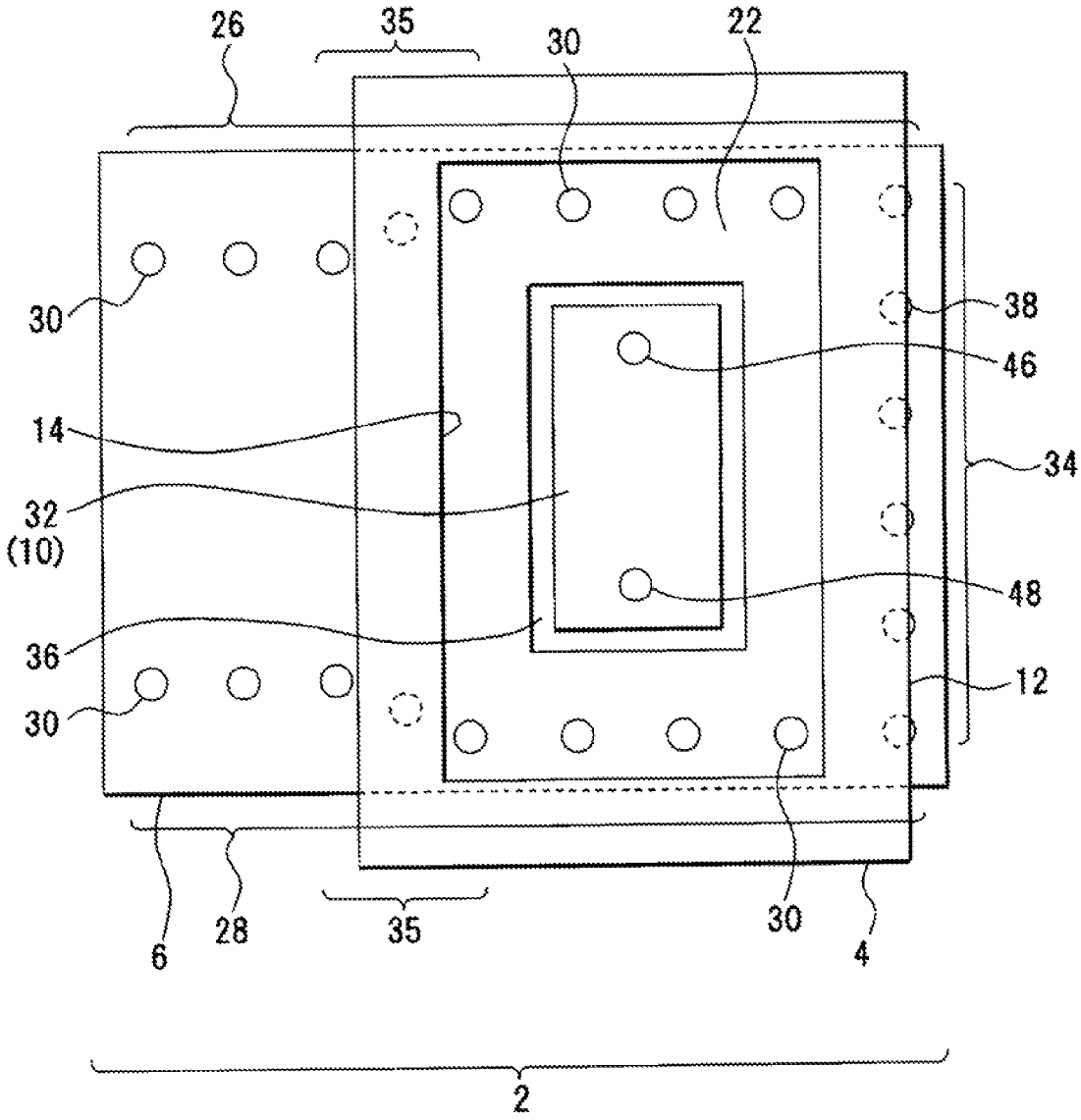
FIG. 31 illustrates an exemplary modification of a signal converter in accordance with another embodiment.

In the first embodiment, a technique of providing a step portion 33 (see FIG. 13) or a taper portion 35 (see FIG. 14) to the width $L_5$ of the waveguide 8 was disclosed. However, a step portion 33 or a taper portion 35 may also be provided in the second embodiment, as illustrated in FIG. 30 and FIG. 31, respectively. Similar portions may also be provided in the third through the ninth embodiments.

Comparative Example

A comparative example will now be described with reference to FIG. 32, FIG. 33, and FIG. 34. In this comparative example, identical reference numbers are used for portions identical to those of the foregoing embodiments.

Figure 32:
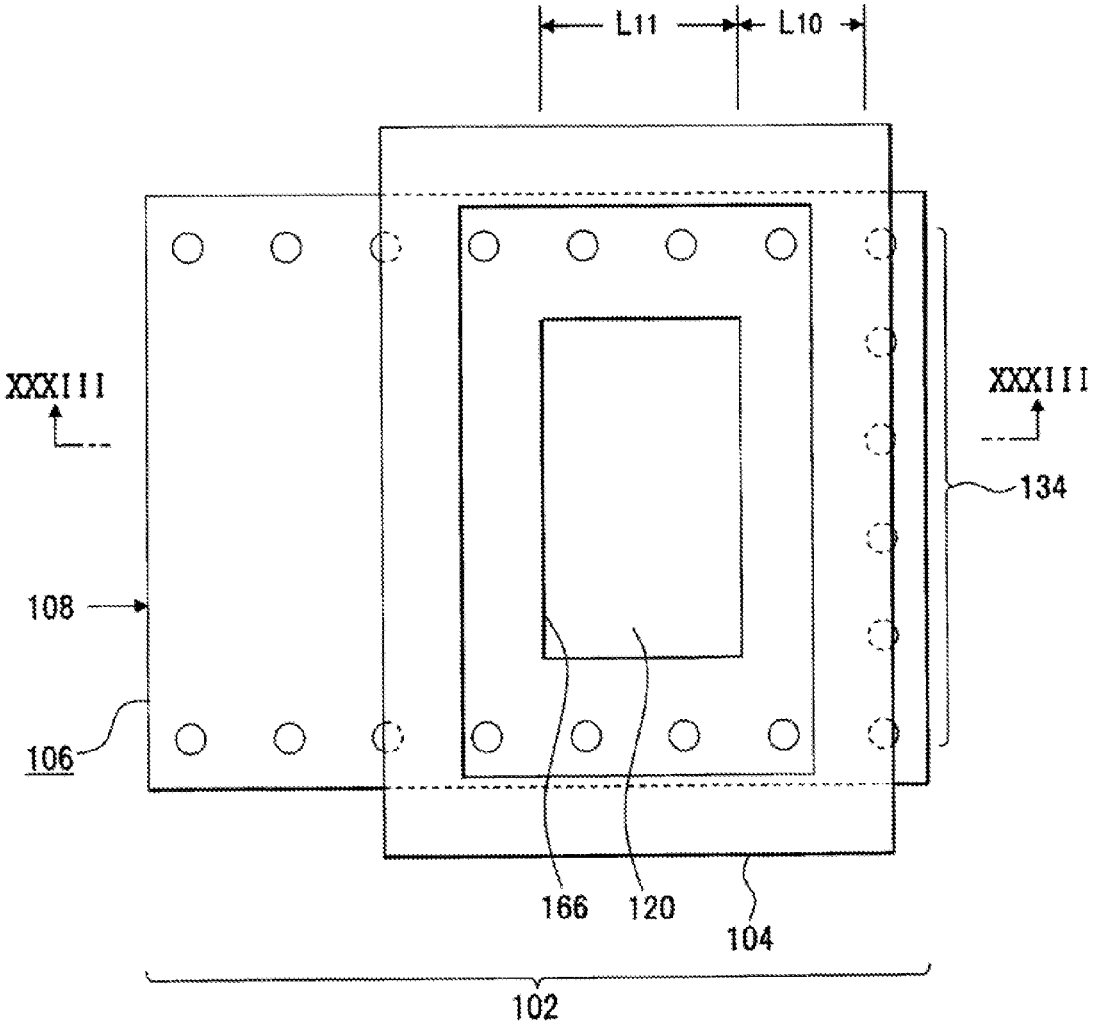
FIG. 32 illustrates a comparative example of a signal converter.
Figure 33:
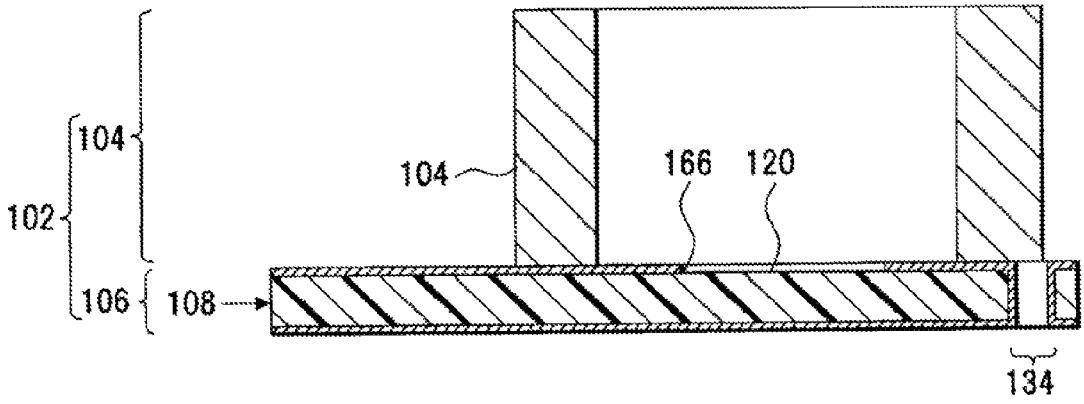
FIG. 33 is a cross section taken along the line XXXIII-XXXIII in FIG. 32.
Figure 34:
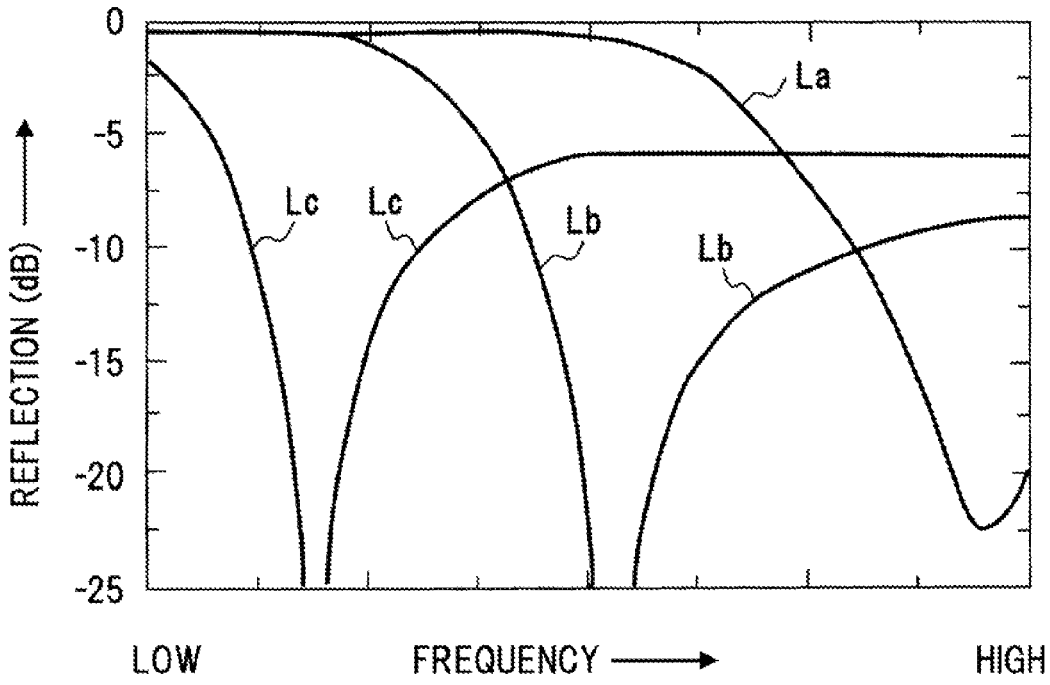
FIG. 34 illustrates the characteristics of the comparative example.

As illustrated in FIG. 32 and FIG. 33, in the signal converter 102 of this comparative example, a coupling window 166 is formed on the surface of the waveguide substrate 106 facing the waveguide 104. The dielectric substrate 120 is exposed by this coupling window 166, and the conductor patch 32 described earlier is not disposed thereon.

With such a configuration, a short wall is realized as a result of the blocking conduction through-hole array 134, with the distance $L_{10}$ from the blocking conduction through-hole array 134 to the coupling window 166 being one-fourth the wavelength (i.e., $\lambda/4$) (see, e.g., FIG. 32). A standing wave is produced as a result of this arrangement, and a resonating signal from the waveguide 108 is led to the waveguide 104. Since the length of the coupling window 166 is comparatively long compared to the waveguide mode travel direction, signals leak out into the waveguide 104 before being reflected at the short wall. Resonance due to the length $L_{11}$ (see, e.g., FIG. 32) of the coupling window 166 is comparatively small, and thus the primary length that determines the desired frequency becomes the distance from the short wall to the coupling window 166. Variation in this length is expressed as variation in the conversion characteristics. Since the drilling or punching conducted to position the blocking conduction through-hole array 134 is a separate manufacturing step from the forming of the coupling window 166, degraded conversion characteristics might result if positioning misalignments are produced.

In the fabrication of such a configuration, it is expected that the blocking conduction through-hole array 134 and the coupling window 166 will be formed in separate manufacturing steps. Ordinarily, the blocking conduction through-hole array 134 would be formed by first creating holes by laser or drilling, for example, and then loading conductive material into the holes. Meanwhile, the coupling window 166 would be formed by etching or similar process, wherein a conductive film is formed while leaving a portion corresponding to the coupling window 166.

For this reason, due to fabrication irregularities in each manufacturing step, it is difficult to accurately set the desired value for the distance that should be secured between the blocking conduction through-hole array 134 and the coupling window 166. Taking L to be the distance between the coupling window 166 and the blocking conduction through-hole array 134, consider the case where signal converters 102 are manufactured with three different values for $L_{10}$: the distances La, Lb, and Lc (where La≠Lb≠Lc). In such as case, the characteristics of signal conversion to the waveguide 104 vary, as illustrated in FIG. 34. In FIG. 34, the horizontal axis represents the frequency of a high-frequency signal, while the vertical axis represents the amount of reflection (in dB) of the high-frequency signal. An increase in the amount of reflection (dB) means that there has been a decrease in the magnitude of the high-frequency signal component that is led to the blocking conduction through-hole array 134.

As demonstrated by these signal conversion characteristics (see FIG. 34), if the distance L between the coupling window 166 and the blocking conduction through-hole array 134 varies (i.e., if L equals La, Lb, or Lc), then irregularities will occur in the reflection characteristics with respect to the frequency of the high-frequency signal which varies between LOW and HIGH. Depending on the frequency of the high-frequency signal being used, the characteristics of propagation to the waveguide 104 may vary greatly. In other words, in order to improve the characteristics of the conversion unit 10, a decrease in the frequency dependence of the reflection characteristics is desired.

In contrast with the above comparative example, such inconveniences do not exist in the foregoing embodiments. The distance between the conductor patch 32 and the blocking conduction through-hole array 34 that acts as a short wall is set to an odd multiple of one-fourth the wavelength $\lambda$ (i.e., $\lambda/4$) of the signal propagated along the waveguide substrate 6. As a result, a standing wave is produced. Since a conductor patch 32 is present before the signal reaches the short wall, and since the junction gap formed by the separator region 36 is comparative narrow, direct leakage is small. Instead, the one-half wavelength ($\lambda/2$) conductor patch 32 strongly resonates, and the signal to be transmitted can be led to the hollow waveguide 4. The halfway position of the conductor patch 32 in the travel direction of the waveguide 8 corresponds to a node of the standing wave, and the conductor patch 32 induces resonance such that the antinodes of the standing wave are produced at the near and far edges of the conductor patch 32 in the travel direction. Consequently, the primary resonance length becomes the length of the conductor patch 32 in the transmission direction, and the relative influence is lowered for the standing wave produced in the distance (i.e., gap) between the short wall made up of the blocking conduction through-hole array 34, and the edge of the gap on the far side of the conductor patch 32 in the travel direction of the waveguide 8. As a result, the influence exerted by the distance to the short wall on the conversion characteristics is significantly reduced. Thus, in the foregoing embodiments, the precision of the positioning can be mitigated in the two manufacturing steps described in the comparative example, the effects on the conversion characteristics due to the error in the single manufacturing step for pattern formation of the conductor layer 22 and the conductor patch 32 can be reduced, and the conversion characteristics can be improved.

The signal converter or the manufacturing method disclosed herein can be used for a high-frequency wave module having a waveguide connection unit for a frequency band such as that of microwaves and EHF waves. For example, the signal converter and manufacturing method disclosed herein can be broadly utilized in technologies such as EHF wave communication systems and automotive radar transceivers.

All examples and conditional language recited herein are intended for pedagogical purposes to aid the reader in understanding the principles of the present invention and the concepts contributed by the inventor to furthering the art, and are to be construed as being without limitation to such specifically recited examples and conditions, nor does the organization of such examples in the specification relate to a showing of the superiority and inferiority of the present invention. Although the embodiment(s) of the present invention(s) has (have) been described in detail, it should be understood that the various changes, substitutions, and alterations could be made hereto without departing from the spirit and scope of the present invention.

The invention claimed is:

1. A signal converter configured to convert a signal between a substrate and an hollow waveguide, comprising:

the substrate including a first conductor layer formed on one face of a dielectric substrate, and a second conductor layer formed on another face of the dielectric substrate;

a plurality of first conductors that penetrate the dielectric substrate and provide conduction between the first conductor layer and the second conductor layer;

a dielectric waveguide formed by the dielectric substrate, the first and second conductor layers, a first array provided with one or more of the plurality of first conductors which is arranged along a signal direction of the dielectric waveguide on one side of the dielectric waveguide, and a second array provided with one or more of the plurality of first conductors which is arranged along the signal direction on another side of the dielectric waveguide, the first and second conductor layers being coupled on the one and other side of the dielectric waveguide via the first and second arrays respectively;

a plurality of blocking conductors that penetrate the dielectric substrate and provide blocking of a signal in the dielectric waveguide; and a converter that converts the signal between the hollow waveguide and the dielectric waveguide;

the converter including a conductor patch having a separator region between the conductor patch and the first conductor layer, with the conductor patch being disposed on the substrate within an aperture of the hollow waveguide, wherein a plurality of second conductors connect the conductor patch with the second conductor layer.

2. The signal converter according to claim 1, wherein the plurality of second conductors which connect the conductor patch with the second conductor layer are provided near a center portion of the conductor patch.

3. The signal converter according to claim 1, wherein the convertor is provided between the first conductor layer and the second conductor layer.

4. The signal converter according to claim 1, wherein the conductor patch has a length corresponding to one-half of a wavelength of a high-frequency signal to be transmitted.

5. The signal converter according to claim 1, wherein the plurality of second conductors which connect the conductor patch with the second conductor layer are provided at portions of the conductor patch, the portions being one of a center portion of the conductor patch in the signal direction and symmetrical to a center portion of the conductor patch in a perpendicular direction to the signal direction.

6. The signal converter according to claim 1, wherein a length of the separator region in the signal direction of the dielectric waveguide is smaller than a thickness of the dielectric substrate.

7. The signal converter according to claim 1, wherein the plurality of second conductors penetrate the dielectric substrate between the conductor patch and the second conductor layer, and the conductor patch is connected to the second conductor layer by the plurality of second conductors.

8. A signal converter configured to convert a signal between a substrate and an hollow waveguide, comprising:

the substrate including a first conductor layer formed on one face of a dielectric substrate, and a second conductor layer formed on another face of the dielectric substrate;

a plurality of first conductors that penetrate the dielectric substrate and provide conduction between the first conductor layer and the second conductor layer;

a dielectric waveguide formed by the dielectric substrate, the first and second conductor layers, a first array provided with one or more of the plurality of first conductors which is arranged along a signal direction of the dielectric waveguide on one side of the dielectric waveguide, a second array provided with one or more of the plurality of first conductors which is arranged along the signal direction on another side of the dielectric waveguide, a third array with one or more of the plurality of first conductors which is arranged along the signal direction of the dielectric waveguide on the one side of the dielectric waveguide, and a fourth array with one or more of the plurality of first conductors which is arranged along the signal direction of the dielectric waveguide on the another side of the dielectric waveguide, the first and second conductor layers being coupled on the one and other side of the dielectric waveguide via the first and second arrays respectively; and a converter that converts the signal between the hollow waveguide and the dielectric waveguide, the convertor including a conductor patch having a separator region between the conductor patch and the first conductor layer, with the conductor patch being disposed on the substrate within an aperture of the hollow waveguide, wherein the first array and the second array are provided so as to sandwich the converter between the first and second arrays, and the third array and the fourth array are provided not so as to sandwich the converter between the third array and the fourth array, a spacing between the first and second arrays is greater than a spacing between the third and fourth arrays.

9. A signal converter configured to convert a signal between a substrate and an hollow waveguide, comprising:

the substrate including a first conductor layer formed on one face of a dielectric substrate, and a second conductor layer formed on another face of the dielectric substrate;

a plurality of first conductors that penetrate the dielectric substrate and provide conduction between the first conductor layer and the second conductor layer;

a dielectric waveguide formed by the dielectric substrate, the first and second conductor layers, a first array provided with one or more of the plurality of first conductors which is arranged along a signal direction of the dielectric waveguide on one side of the dielectric waveguide, and a second array provided with one or more of the plurality of first conductors which is arranged along the signal direction on another side of the dielectric waveguide, the first and second conductor layers being coupled on the one and other side of the dielectric waveguide via the first and second arrays respectively;

a plurality of blocking conductors that penetrate the dielectric substrate and provide blocking of a signal in the dielectric waveguide; and a converter that converts the signal between the hollow waveguide and the dielectric waveguide;

the convertor including a conductor patch having a separator region between the conductor patch and the first conductor layer, with the conductor patch being disposed on the substrate within an aperture of the hollow waveguide, wherein a length of the separator region in the signal direction of the dielectric waveguide is smaller than a thickness of the dielectric substrate.

10. A signal converter configured to convert a signal between a substrate and an hollow waveguide, comprising:

the substrate including a first conductor layer formed on one face of a dielectric substrate, and a second conductor layer formed on another face of the dielectric substrate;

a plurality of first conductors that penetrate the dielectric substrate and provide conduction between the first conductor layer and the second conductor layer;

a dielectric waveguide formed by the dielectric substrate, the first and second conductor layers, a first array provided with one or more of the plurality of first conductors which is arranged along a signal direction of the dielectric waveguide on one side of the dielectric waveguide, a second array provided with one or more of the plurality of first conductors which is arranged along the signal direction on another side of the dielectric waveguide, a third array with one or more of the plurality of first conductors which is arranged along the signal direction of the dielectric waveguide on the one side of the dielectric waveguide, and a fourth array with one or more of the plurality of first conductors which is arranged along the signal direction of the dielectric waveguide on the another side of the dielectric waveguide, the first and second conductor layers being coupled on the one and other side of the dielectric waveguide via the first and second arrays respectively;

a plurality of blocking conductors that penetrate the dielectric substrate and provide blocking of a signal in the dielectric waveguide; and a converter that converts the signal between the hollow waveguide and the dielectric waveguide, the converter including a conductor patch having a separator region between the conductor patch and the first conductor layer, with the conductor patch being disposed on the substrate within an aperture of the hollow waveguide; and a connector that connects the conductor patch with the first conductor layer, wherein the connector has a width that is smaller than a width of the conductor patch.

11. A method of manufacturing a signal converter, comprising:

forming a substrate comprising providing a first conductor layer on one face of a dielectric substrate, providing a second conductor layer provided on another face of the dielectric substrate, providing a plurality of first conductors that penetrate the dielectric substrate and provide conduction between the first conductor layer and the second conductor layer, forming a dielectric waveguide using a dielectric material portion of the dielectric substrate, and surrounded by the first and second conductor layers as well as the plurality of first conductors, wherein a first array is provided with one or more of the plurality of first conductors which is arranged along a signal direction of the dielectric waveguide on one side of the dielectric waveguide, and a second array is provided with one or more of the plurality of first conductors which is arranged along the signal direction on another side of the dielectric waveguide, the first and second conductor layers being coupled on the one and other side of the dielectric waveguide via the first and second arrays respectively;

providing a plurality of blocking conductors that penetrate the dielectric substrate and provide blocking of a signal in the dielectric waveguide;

providing a conductor patch at a converter formed in the dielectric waveguide;

providing a separator region between the conductor patch and the first conductor layer;

joining the substrate with a hollow waveguide, connecting the conductor patch and the first conductor layer using a plurality of second conductors.

12. The method according to claim 11, wherein a length of the separator region in the signal direction of the dielectric waveguide is smaller than a thickness of the dielectric substrate.

* * * * *